US009141007B2

(12) United States Patent
Hamasaki et al.

(10) Patent No.: US 9,141,007 B2
(45) Date of Patent: Sep. 22, 2015

(54) MONOLAYER TYPE PHOTOCONDUCTOR AND IMAGE FORMING DEVICE

(75) Inventors: Kazunari Hamasaki, Osaka (JP); Yuko Iwashita, Osaka (JP); Daisuke Kuboshima, Osaka (JP); Keiji Maruo, Osaka (JP); Shiho Kuboshima, Osaka (JP)

(73) Assignee: Kyocera Mita Corporation (JP)

( * ) Notice: Subject to any disclaimer, the term of this patent is extended or adjusted under 35 U.S.C. 154(b) by 616 days.

(21) Appl. No.: 12/047,401

(22) Filed: Mar. 13, 2008

(65) Prior Publication Data

US 2008/0305418 A1 Dec. 11, 2008

(30) Foreign Application Priority Data

Mar. 29, 2007 (JP) ..... 2007-086512

(51) Int. Cl.

| | |
|---|---|
| ***G03G 15/06*** | (2006.01) |
| ***G03G 5/06*** | (2006.01) |
| ***G03G 5/05*** | (2006.01) |

(52) U.S. Cl.

CPC ..... *G03G 5/0696* (2013.01); *G03G 5/0564* (2013.01); *G03G 5/0609* (2013.01); *G03G 5/0614* (2013.01); *G03G 5/0668* (2013.01); *G03G 5/0672* (2013.01); *G03G 5/0677* (2013.01)

(58) Field of Classification Search

USPC ..... 430/56.5, 78

See application file for complete search history.

(56) References Cited

U.S. PATENT DOCUMENTS

| | | | | | |
|---|---|---|---|---|---|
| 5,190,839 | A | | 3/1993 | Fujimaki et al. | |
| 5,371,213 | A | * | 12/1994 | Mayo | 540/141 |
| 5,567,560 | A | * | 10/1996 | Hagiwara et al. | 430/58.85 |
| 5,573,878 | A | * | 11/1996 | Hagiwara et al. | 430/58.15 |
| 5,736,284 | A | * | 4/1998 | Kobayashi et al. | 430/79 |
| 5,800,956 | A | * | 9/1998 | Minemura et al. | 430/60 |
| 5,882,813 | A | * | 3/1999 | Matsushima et al. | 430/58.45 |
| 5,910,610 | A | * | 6/1999 | Kobayashi et al. | 564/315 |
| 5,942,615 | A | * | 8/1999 | Kobayashi et al. | 544/38 |
| 5,989,765 | A | * | 11/1999 | Kobayashi et al. | 430/58.75 |
| 6,083,651 | A | * | 7/2000 | Kobayashi et al. | 430/58.15 |
| 6,150,065 | A | * | 11/2000 | Kobayashi et al. | 430/83 |

(Continued)

FOREIGN PATENT DOCUMENTS

| | | |
|---|---|---|
| JP | 8106165 | 4/1996 |
| JP | 8-176456 | 7/1996 |

(Continued)

*Primary Examiner* — Stewart Fraser
*Assistant Examiner* — Rachel Zhang
(74) *Attorney, Agent, or Firm* — Gerald E. Hespos; Michael J. Porco; Matthew T. Hespos

(57) ABSTRACT

Provided is a monolayer type photoconductor superior in sensitivity characteristics that allows reliable production by easy confirmation of the sensitivity characteristics, and an image forming device using such a monolayer type photoconductor. A monolayer type photoconductor including a base body and a single photo sensitive layer formed on the base body, the single photo sensitive layer containing a charge generating agent, a hole transfer agent, an electron transfer agent and a binding resin, wherein a maximum absorption wavelength ($\lambda_{max}$) of the photo sensitive layer is set to a value of below 850 nm and an absorbance ($A_{850}$) of light at a wavelength of 850 nm per unit thickness of the photo sensitive layer is set to a value of 0.05 $\mu m^{-1}$ or less.

8 Claims, 8 Drawing Sheets

(56) References Cited

U.S. PATENT DOCUMENTS

| | | | | |
|---|---|---|---|---|
| 6,172,264 | B1 * | 1/2001 | Kobayashi et al. | 564/433 |
| 6,228,547 | B1 * | 5/2001 | Kobayashi et al. | 430/72 |
| 6,528,645 | B1 * | 3/2003 | Hamasaki et al. | 540/141 |
| 2003/0235769 | A1 * | 12/2003 | Zhu et al. | 430/56 |
| 2006/0147823 | A1 * | 7/2006 | Kobayashi et al. | 430/58.85 |
| 2006/0160005 | A1 * | 7/2006 | Kuboshima et al. | 430/96 |
| 2007/0003853 | A1 * | 1/2007 | Inagaki et al. | 430/66 |
| 2007/0054209 | A1 * | 3/2007 | Azuma et al. | 430/73 |
| 2007/0111123 | A1 * | 5/2007 | Otsubo et al. | 430/78 |
| 2007/0218379 | A1 * | 9/2007 | Kuboshima et al. | 430/78 |

FOREIGN PATENT DOCUMENTS

| | | |
|---|---|---|
| JP | 2002351107 | 12/2002 |
| JP | 3463032 | 8/2003 |
| JP | 2004-145284 | 5/2004 |
| JP | 200562221 | 3/2005 |
| JP | 2006126672 | 5/2006 |

* cited by examiner

MONOLAYER TYPE PHOTOCONDUCTOR AND IMAGE FORMING DEVICE

BACKGROUND OF THE INVENTION

1. Field of the Invention

The present invention relates to a monolayer type photoconductor and an image forming device. In particular, the invention relates to a monolayer type photoconductor superior in sensitivity characteristics that allows reliable production while allowing easier confirmation of the sensitivity characteristics, and an image forming device using the same.

2. Description of the Related Art

Generally, an increasing number of organic photoreceptors have been used recently as electrophotographic photoconductors for electrophotographic devices such as a copying machine and a laser printer, because of the requirements for lower price, lower environmental pollution and others. Phthalocyanine pigments, which are sensitive to light at an infrared to near-infrared wavelength region that is irradiated, for example, from a semiconductor laser or infrared LED, have been used widely as charge generating agents for use in such organic photoreceptors.

The phthalocyanine pigments are grouped into non-metal phthalocyanine compounds, copper phthalocyanine compounds, titanyl phthalocyanine compounds, and others, depending on chemical structure, and it is known that each phthalocyanine compound can have various crystal forms based on the difference in its production condition.

Among the various phthalocyanine compound crystals different in crystal form currently available, electrophotographic photoconductors employing titanyl phthalocyanine in the Y-type crystal structure as the charge generating agent are known to have electrical properties more favorable than those employing titanyl phthalocyanine in another crystal form.

The Y-type titanyl phthalocyanine crystal is, for example, a titanyl phthalocyanine crystal having a maximum diffraction peak at a Cu—Kα Bragg angle 2θ of 27.3°±0.2° in the X-ray diffraction spectrum, and disclosed is a method of producing a titanyl phthalocyanine crystal in reaction of a phthalocyanine ring-forming organic compound and a titanium in a dialkylaminoalcohol containing added urea or ammonia at 130° C. for about 4 hours (see, e.g., Patent Document 1).

Also disclosed are methods of preparing a titanyl phthalocyanine crystal in direct reaction between o-phthalonitrile and titanium tetrabutoxide in the absence of a urea compound under the condition at 215° C. for about 2 hours (see, e.g., Patent Documents 2 and 3).

More specifically, disclosed is a method of producing a titanyl phthalocyanine crystal having peaks in predetermined ranges of the CuKα X-ray diffraction spectrum and having no temperature variation peak in the range of 50 to 400° C. in differential scanning calorimetry.

[Patent Document 1] JP-8-176456A (Examples)

[Patent Document 2] JP-3463032B (Claims)

[Patent Document 3] JP-2004-145284A (Claims)

However, although it is possible to prepare titanyl phthalocyanine crystals respectively having a desired crystal form according to the methods in Patent Documents 1 to 3, electrophotographic photoconductors prepared by using the titanyl phthalocyanine crystals obtained often show a significant difference in sensitivity characteristics.

The difference in sensitivity characteristics seems to be caused by fluctuation in dispersibility of the titanyl phthalocyanine crystal in a photo sensitive layer, which is in turn caused by a slight difference in the amount of impurities remaining in the crystal.

Thus, it is needed to measure the sensitivity characteristics actually for control of the fluctuation in quality, which is the reason of the low productivity of the electrophotographic photoconductor.

SUMMARY OF THE INVENTION

After intensive studies, the inventors have found that by adjusting a maximum absorption wavelength of a photo sensitive layer in a monolayer type photoconductor and an absorbance of light at a predetermined wavelength per unit thickness of the photo sensitive layer in favorable ranges, it is possible to make the dispersibility of a charge generating agent in the photo sensitive layer favorable thereby to improve sensitivity characteristics, and thus they have achieved the present invention.

That is, an object of the present invention is to provide a monolayer type photoconductor superior in sensitivity characteristics that allows reliable production by easy confirmation of the sensitivity characteristics, and an image forming device using such a monolayer type photoconductor.

According to one aspect of the present invention, there is provided a monolayer type photoconductor, including a base body and a single photo sensitive layer formed on the base body, the single photo sensitive layer containing a charge generating agent, a hole transfer agent, an electron transfer agent and a binding resin, wherein a maximum absorption wavelength ($\lambda_{max}$) of the photo sensitive layer is set to a value of below 850 nm and an absorbance ($A_{850}$) of light at a wavelength of 850 nm per unit thickness of the photo sensitive layer is set to a value of 0.05 $\mu m^{-1}$ or less. With the monolayer type photoconductor, it is possible to solve the problems described above.

Thus, it is possible to make the dispersibility of the charge generating agent in the photo sensitive layer favorable by adjusting the maximum absorption wavelength of the photo sensitive layer in the monolayer type photoconductor and also the absorbance of light at a predetermined wavelength per unit thickness of the photo sensitive layer in favorable ranges.

As a result, it is possible to determine the dispersibility of the charge generating agent, which deteriorates easily for some reasons, and the sensitivity characteristics of the electrophotographic photoconductor that is significantly dependent thereon without actual measurement of the sensitivity characteristics. This makes it possible to obtain an electrophotographic photoconductor superior in sensitivity characteristics reliably.

The dispersibility of the charge generating agent and the sensitivity characteristics of the electrophotographic photoconductor have a close relationship with each other, and it is known that, when the dispersibility of the charge generating agent is more favorable, the sensitivity characteristics of the electrophotographic photoconductor is also improved.

When configuring the monolayer type photoconductor according to the present invention, the maximum absorption wavelength ($\lambda_{max}$) of the photo sensitive layer and the absorbance ($A_{850}$) of light at a wavelength of 850 nm per unit thickness of the photo sensitive layer preferably satisfy the following relationship formula (1).

$$16 \leq \lambda_{max}/A_{850}(1\times10^{-12}\,m^2) \leq 20 \quad (1)$$

In such a configuration, it is possible to make the dispersibility of the charge generating agent in the photo sensitive layer more favorable.

When configuring the monolayer type photoconductor according to the present invention, an absorbance ($A_{780}$) of light at a wavelength of 780 nm per unit thickness of the photo sensitive layer is preferably 0.045 ($\mu m^{-1}$) or more.

In such a configuration, it is possible to improve the sensitivity characteristics to the light at a wavelength actually irradiated effectively.

Also when configuring the monolayer type photoconductor according to the present invention, the charge generating agent is preferably a titanyl phthalocyanine crystal having a maximum peak at a Bragg angle 2θ of 27.2°±0.2° in a CuKα X-ray diffraction spectrum.

The configuration enables significant improvement in the charge generating efficiency.

When configuring the monolayer type photoconductor according to the present invention, it is preferable to use as the titanyl phthalocyanine crystal a titanyl phthalocyanine crystal having an absorbance of light at a wavelength of 400 nm in the range of 0.01 to 0.08, as determined by suspending 1.25 parts by weight of the titanyl phthalocyanine crystal in 100 parts by weight of a mixed solvent of methanol and N,N-dimethylformamide (methanol:N,N-dimethylformamide=1:1 (by weight)) and filtering the suspension through a filter.

With this configuration, it is possible to obtain reliably a titanyl phthalocyanine crystal extremely higher in purity and superior in dispersibility and charge generating efficiency.

It is thus possible to improve the sensitivity characteristics of the electrophotographic photoconductor further more effectively.

The absorbance of light at a wavelength of 400 nm is monitored as an indicator of impurities, because the correlation between the absorbance of the light at the wavelength and the charge generating efficiency of the titanyl phthalocyanine crystal, for example, is known empirically.

Upon configuring the monolayer type photoconductor according to the present invention, the titanyl phthalocyanine crystal preferably has the following property (a) or (b):

(a) there is no peak other than the peak due to vaporization of adsorbed water in the range of 50 to 400° C. in differential scanning calorimetry; or (b) there is no peak other than the peak due to vaporization of adsorbed water in the range of 50 to 270° C., but there is one peak in the range of 270 to 400° C. in differential scanning calorimetry.

This configuration enables further improvement in the storability and the dispersibility of the crystal form when the titanyl phthalocyanine crystal is added to the photo sensitive layer application liquid as a charge generating agent.

When configuring the monolayer type photoconductor according to the present invention, a content of the charge generating agent is preferably in the range of 0.1 to 50 parts by weight with respect to 100 parts by weight of the binding resin.

With this configuration, the dispersibility of the charge generating agent in the photo sensitive layer can be further improved.

Upon configuring the monolayer type photoconductor according to the present invention, the hole transfer agent is preferably a triarylamine compound represented by the following General Formula (1):

(1)

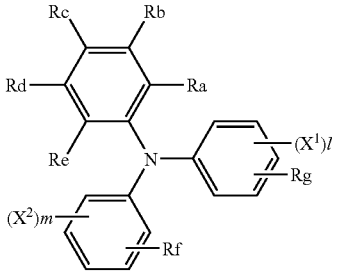

wherein Ra to Rg each independently represents a hydrogen or halogen atom, an alkyl group having 1 to 20 carbon atoms, an alkoxy group having 1 to 20 carbon atoms, a substituted or unsubstituted aryl group having 6 to 30 carbon atoms, or neighboring two substituents among Ra to Re may form a hydrocarbon ring structure; $X^1$ and $X^2$ each independently represents a substituent represented by the following General Formula (2); and each of the repetition numbers l and m is an integer satisfying (l+m≥2):

(2)

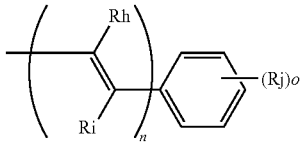

wherein Rh to Ri each independently represents a hydrogen atom, an alkyl group having 1 to 20 carbon atoms, or a substituted or unsubstituted aryl group having 6 to 30 carbon atoms; the repetition number n is an integer of 1 to 2; Rj represents a halogen atom, an alkyl group having 1 to 20 carbon atoms, an alkoxy group having 1 to 20 carbon atoms, or a substituted or unsubstituted aryl group having 6 to 30 carbon atoms; and the repetition number o is an integer of 0 to 5.

With this configuration, it is possible to make clearer the relationship between the light-absorbing property of the photo sensitive layer and the dispersibility of the charge generating agent described above and to further improve the sensitivity characteristics of the electrophotographic photoconductor.

Also when configuring the monolayer type photoconductor according to the present invention, the electron transfer agent is preferably at least one compound selected from the group consisting of the compounds represented by the following General Formulae (3) to (5):

(3)

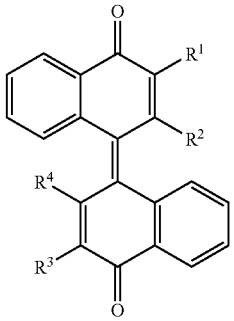

wherein $R^1$ to $R^4$ each independently represents a hydrogen or halogen atom, a substituted or unsubstituted alkyl group having 1 to 20 carbon atoms, a substituted or unsubstituted alkoxy group having 1 to 20 carbon atoms, or a substituted or unsubstituted aryl group having 6 to 30 carbon atoms, (4)

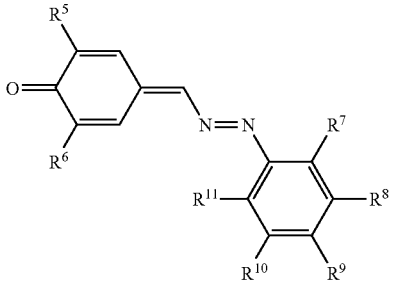

wherein $R^5$ to $R^6$ each independently represents a hydrogen atom, a substituted or unsubstituted alkyl group having 1 to 20 carbon atoms, a substituted or unsubstituted alkoxy group having 1 to 20 carbon atoms, a substituted or unsubstituted aryl group having 6 to 30 carbon atoms, a substituted or unsubstituted cycloalkyl group having 6 to 30 carbon atoms, or a substituted or unsubstituted aralkyl group having 7 to 20 carbon atoms; $R^7$ to $R^{11}$ each independently represents a hydrogen or halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 7 to 20 carbon atoms, a substituted or unsubstituted phenoxy group having 6 to 30 carbon atoms, a cyano group, a nitro group, or a heterocyclic group formed by two or more groups above binding to each other, and (5)

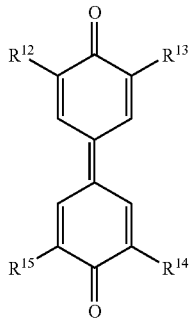

wherein the substituted groups $R^{12}$ to $R^{15}$ each independently represents a hydrogen atom, a substituted or unsubstituted alkyl group having 1 to 20 carbon atoms, a substituted or unsubstituted aryl group having 6 to 30 carbon atoms, a substituted or unsubstituted alkoxy group having 1 to 20 carbon atoms, or a substituted or unsubstituted cycloalkyl group having 6 to 30 carbon atoms.

With this configuration, it is possible to make clearer the relationship between the light-absorbing property of the photo sensitive layer and the dispersibility of the charge generating agent described above and to further improve the sensitivity characteristics of the electrophotographic photoconductor.

Also upon configuring the monolayer type photoconductor according to the present invention, a thickness of the photo sensitive layer is preferably in the range of 5 to 100 μm.

This configuration makes it possible to make clearer the relationship between the light-absorbing property of the photo sensitive layer and the dispersibility of the charge generating agent described above.

Another aspect of the present invention is an image forming device, including any one of the monolayer type photoconductors described above and electrification means, exposure means, developing means and transfer means arranged around the monolayer type photoconductor, wherein a process speed is set to a value of 100 mm/sec or more.

Thus, high-quality images can be formed even at an elevated process speed because the monolayer type photoconductor mounted is superior in sensitivity characteristics.

DETAILED DESCRIPTION OF THE PREFERRED EMBODIMENTS

First Embodiment

Figure 1:
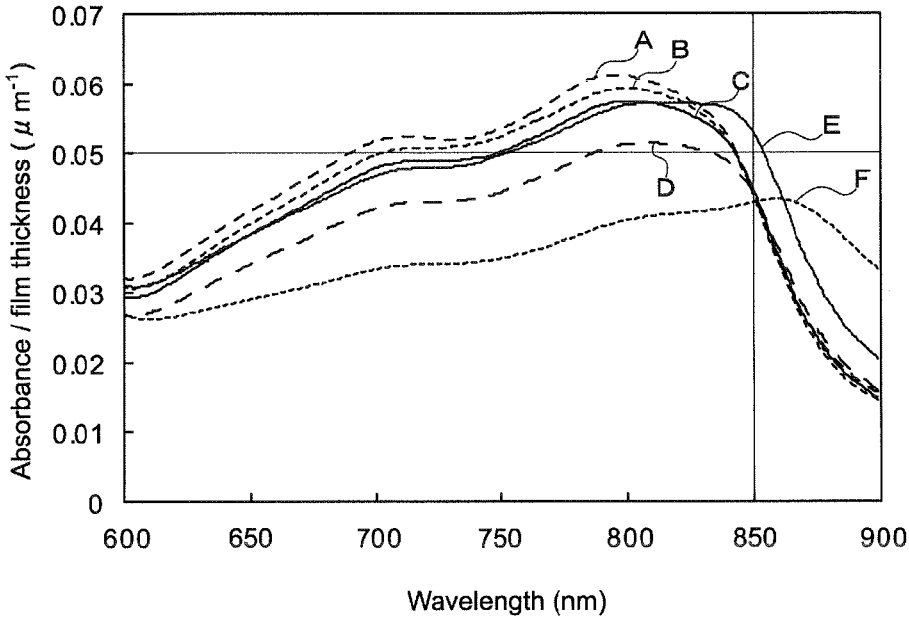
FIG. 1 is a graph showing the absorption spectra per unit thickness of a photo sensitive layer.

A first embodiment is a monolayer type photoconductor, including a base body and a single photo sensitive layer formed on the base body, the single photo sensitive layer containing a charge generating agent, a hole transfer agent, an electron transfer agent and a binding resin, wherein, as shown in FIG. 1, a maximum absorption wavelength ($\lambda_{max}$) of the photo sensitive layer is set to a value of below 850 nm and an absorbance ($A_{850}$) of light at a wavelength of 850 nm per unit thickness of the photo sensitive layer is set to a value of 0.05 ($\mu m^{-1}$) or less.

Hereinafter, components for the monolayer type photoconductor in the first embodiment will be described specifically.

1. Basic Configuration

Figure 2A:
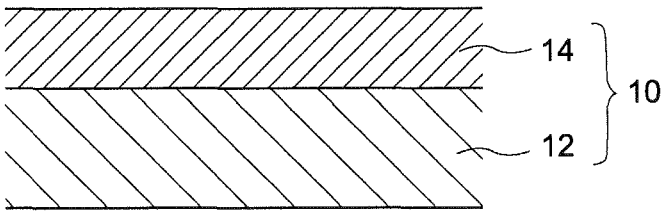
FIGS. 2A and 2B are views each illustrating the configuration of a monolayer type photoconductor according to the present invention.

As shown in FIG. 2A, the basic configuration of a monolayer type photoconductor 10 according to the present invention is preferably such that a single photo sensitive layer 14 containing a charge generating agent, a charge transfer agent and a binding resin is formed on a base body 12.

Figure 2B:
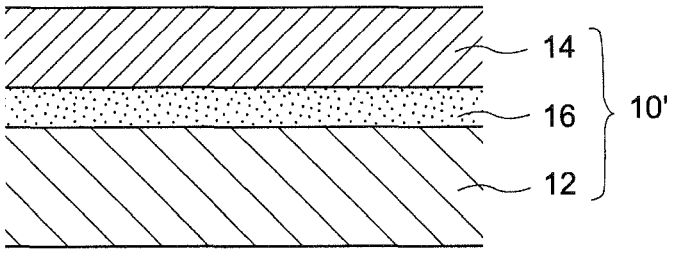

Alternatively as exemplified in FIG. 2B, it may be a monolayer type photoconductor 10' having an intermediate layer 16 formed between the photo sensitive layer 14 and the base body 12.

2. Base Body

Any one of various conductive materials may be used as the base body 12 exemplified in FIG. 2. Examples thereof include metals such as iron, aluminum, copper, tin, platinum, silver, vanadium, molybdenum, chromium, cadmium, titanium, nickel, palladium, indium, stainless steel, and brass; plastic materials vapor-deposited or laminated with the metal described above; and glasses coated with alumite, aluminum iodide, tin oxide, or indium oxide.

The shape of the base body may be sheet-shaped, drum-shaped or the like according to the structure of an image forming device used as long as the base body itself is conductive, or the surface of the base body is conductive. The base body preferably has sufficient mechanical strength during use. If drum-shaped, the base body preferably has a diameter in the range of 10 to 60 mm, more preferably 10 to 35 mm, for reduction of the apparatus in size.

For prevention of interference fringes, the surface of the supporting base body may be roughened, for example, by processing such as etching, anodization, wet blasting, sand blasting, rough grinding, or centerless grinding.

The base body, when processed, for example, by anodization, often becomes non-conductive or semi-conductive. However, even in such a case too, it may be used as the base body as long as the desired advantageous effects are obtained.

3. Intermediate Layer

As shown in FIG. 2B, an intermediate layer 16 containing a predetermined binding resin may be formed on the base body 12.

This is because it is possible to improve adhesion between the base body and the photo sensitive layer and addition of a predetermined fine powder into the intermediate layer prevents interference fringes by scattering of the incident beam, and also prevents charge injection from the base body into the photo sensitive layer during a non-photoirradiation period, which causes high background soil and black spot. The fine powder is not particularly limited as long as it is light scattering and dispersible, and examples thereof include white pigments such as titanium oxide, zinc oxide, zinc white, zinc sulfide, white lead, and lithopone; extender inorganic pigments such as alumina, calcium carbonate, and barium sulfate; fluoroplastic particles; benzoguanamine resin particles; and styrene resin particles.

A film thickness of the intermediate layer is preferably in the range of 0.1 to 50 μm. This is because an excessively thin intermediate layer may cause a residual potential on the photoconductor surface, possibly leading to deterioration in electrical properties, while on the other hand, an excessively thin intermediate layer results in insufficient relaxation of the surface irregularity of the base body, prohibiting favorable adhesion between the base body and the photo sensitive layer.

Accordingly, the film thickness of the intermediate layer is preferably in the range of 0.1 to 50 μm, more preferably in the range of 0.5 to 30 μm.

4. Photo Sensitive Layer (1) Binding Resin

The kind of the binding resin used in the electrophotographic photoconductor according to the invention is not particularly limited, and examples thereof include thermoplastic resins such as polycarbonate resins, polyester resins, polyarylate resins, styrene-butadiene copolymers, styrene-acrylonitrile copolymers, styrene-maleic acid copolymers, acrylic copolymers, styrene-acrylic acid copolymers, polyethylene, ethylene-vinyl acetate copolymers, chlorinated polyethylenes, polyvinyl chloride, polypropylene, ionomers, vinyl chloride-vinyl acetate copolymers, alkyd resins, polyamide, polyurethane, polysulfone, diallylphthalate resins, ketone resins, polyvinylbutyral resins, and polyether resins; and photocuring resins such as silicone resins, epoxy resins, phenol resins, urea resins, melamine resins, others crosslinkable thermosetting resins, epoxy acrylate, and urethane-acrylate.

(2) Charge Generating Agent (2)-1 Kind

The kind of the charge generating agent used in the electrophotographic photoconductor according to the invention is not particularly limited, and in particular, a titanyl phthalocyanine crystal is preferably used.

This is because, with the titanyl phthalocyanine crystal, it is possible to specify the relationship between the light-absorbing property of the photo sensitive layer and the dispersibility of the charge generating agent definitely, as will be described below in detail.

Accordingly, it is possible to determine the dispersibility of the charge generating agent in the photo sensitive layer without actual measurement of the sensitivity characteristics, and thus to obtain an electrophotographic photoconductor superior in sensitivity characteristics reliably.

Among titanyl phthalocyanine crystals, preferable is a titanyl phthalocyanine crystal in a specific crystal form having a maximum peak at a Bragg angle 2θ of 27.2°±0.2° in the CuKα X-Ray diffraction spectrum.

This is because the titanyl phthalocyanine crystal in such a specific crystal form improves the charge generating efficiency drastically.

Specifically, the titanyl phthalocyanine crystal in such a specific crystal form has a charge generating efficiency drastically higher than that of the titanyl phthalocyanine crystals in other crystal forms.

Accordingly, when a titanyl phthalocyanine crystal in such a specific crystal form is used as the charge generating agent in the electrophotographic photoconductor, charges can be efficiently generated by exposure of the electrophotographic photoconductor surface to thereby form an electrostatic latent image at favorable sensitivity.

Hereinafter, the titanyl phthalocyanine crystal in such a specific crystal form will be described in more detail.

(i) Titanyl Phthalocyanine Compound

The titanyl phthalocyanine compound for the titanyl phthalocyanine crystal in a specific crystal form is preferably a compound represented by the following General Formula (6).

This is because the titanyl phthalocyanine compound having such a structure can further improve the stability of the titanyl phthalocyanine crystal in a specific crystal form and can also produce the titanyl phthalocyanine crystal more reliably.

In particular, the structure of the titanyl phthalocyanine compound is preferably represented by the following General Formula (7). In particular among them, an unsubstituted titanyl phthalocyanine compound (CGM-1) represented by the following Formula (8) is favorable.

This is because using the titanyl phthalocyanine compound having such a structure can more easily produce more stabilized titanyl phthalocyanine crystal.

(6)

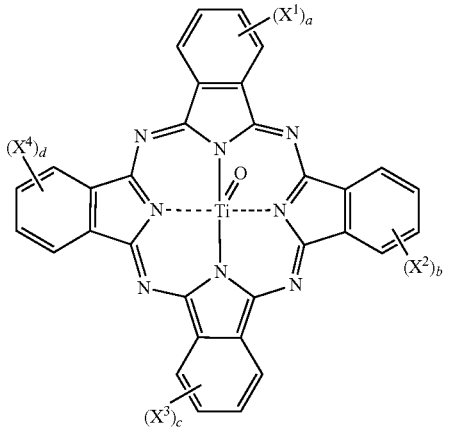

(In Formula (6), $X^1$, $X^2$, $X^3$, and $X^4$ are substituent groups that may be the same or different from each other, and each independently represents a hydrogen or halogen atom, an alkyl group, an alkoxy group, a cyano group, or a nitro group; and the repetition numbers a, b, c and d each independently represents an integer of 1 to 4, and may be the same or different from each other).

(7)

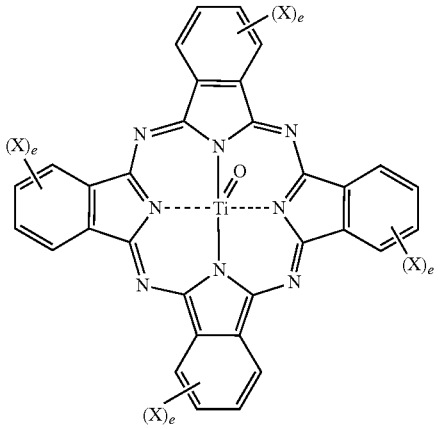

(In Formula (7), X represents a hydrogen or halogen atom, an alkyl group, an alkoxy group, a cyano group or a nitro group; and the repetition number e is an integer of 1 to 4).

(8)

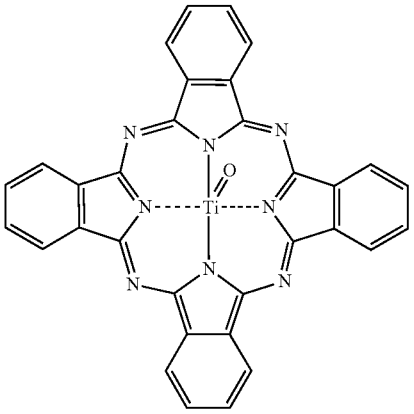

(CGM-1)

(ii) Titanyl Phthalocyanine Crystal (ii)-1 Optical and Thermal Properties

The titanyl phthalocyanine crystal preferably has the following property (a) or (b):

(a) there is no peak other than the peak due to vaporization of adsorbed water in the range of 50 to 400° C. in differential scanning calorimetry, or (b) there is no peak other than the peak due to vaporization of adsorbed water in the range of 50 to 270° C., but there is one peak in the range of 270 to 400° C. in differential scanning calorimetry.

This is because this configuration enables further improvement in the stability and dispersibility of the crystal form when the titanyl phthalocyanine crystal is added to the photo sensitive layer application liquid as a charge generating agent.

More specifically, when the titanyl phthalocyanine crystal has the property (a), the titanyl phthalocyanine crystal is a stabilized crystal resistant to crystal transition.

That is, even when a photo sensitive layer application liquid is used after storage for a certain period from its production, it is possible to prevent transition of the titanyl phthalocyanine crystal from a specific crystal form to the α- or β-form by action of an organic solvent such as tetrahydrofuran contained in the photosensitive layer application liquid. This allows the specific crystal form that is superior in charge generation to be preserved.

When the titanyl phthalocyanine crystal has the property (b), it is possible to further improve the storability and dispersibility of the titanyl phthalocyanine crystal in the photo sensitive layer application liquid.

More specifically, when the titanyl phthalocyanine crystal has the property (b), the crystal is resistant to crystal transition in an organic solvent and shows particularly favorable dispersibility in the photo sensitive layer application liquid.

That is, charges can be generated extremely efficiently in the photo sensitive layer during photoirradiation, because it is possible to preserve the specific crystal form without transition of the crystal form to α- or β-form in preparing the photo sensitive layer application liquid for production of the photo sensitive layer, and also improve the dispersibility thereon in the photo sensitive layer application liquid. Further, the increase in dispersibility leads to improvement in charge transportation between the titanyl phthalocyanine crystal and the charge transfer agent, and consequently to improvement in sensitivity to the exposure.

The one peak other than the peak due to vaporization of adsorbed water observed in the range of 270 to 400° C., is preferably observed in the range of 290 to 400° C., more preferably in the range of 300 to 400° C.

The titanyl phthalocyanine crystal preferably has the following property (c):

(c) there is a maximum peak having a Bragg angle 2θ at least at 27.2°±0.2° but no peak at a Bragg angle of 26.2° in the CuKα X-ray diffraction spectrum, after immersion in an organic solvent for 24 hours.

This is because, when the titanyl phthalocyanine crystal has the property (c), it is possible to further improve the storability and the dispersibility of the titanyl phthalocyanine crystal in the photo sensitive layer application liquid.

In other words, that is because, even when the titanyl phthalocyanine crystal is actually immersed in an organic solvent for 24 hours, it is possible to confirm preservation of a specific crystal form without transition to α- or β-form to thereby control the crystal transition in the organic solvent.

The organic solvent described above is preferably at least one solvent selected from the group consisting of a tetrahydrofuran, dichloromethane, toluene, 1,4-dioxane and 1-methoxy-2-propanol.

This is because the organic solvent is actually used in production of the photo sensitive layer application liquid, and thus the stability of the titanyl phthalocyanine crystal can be determined more reliably.

The method of measuring the thermal and optical properties of the titanyl phthalocyanine crystal will be described below in Examples.

(ii)-2 Absorbance

Preferably used as the titanyl phthalocyanine crystal is a titanyl phthalocyanine crystal having an absorbance of light at a wavelength of 400 nm, as determined as a solution obtained by suspending 1.25 parts by weight of the titanyl phthalocyanine crystal in 100 parts by weight of a mixed solvent of methanol and N,N-dimethylformamide (methanol: N,N-dimethylformamide=1:1 (by weight)) and filtering the suspension, in the range of 0.01 to 0.08.

This is because, with such an organic solvent described above, impurities contained in the titanyl phthalocyanine crystal can be eluted effectively so that a titanyl phthalocyanine crystal can be obtained stably, which is extremely higher in purity and superior in dispersibility and charge generating efficiency by adjusting the absorbance of the filtrate.

It is thus possible to improve the sensitivity characteristics of the electrophotographic photoconductor more effectively.

An absorbance by the filtrate of light at a wavelength of 400 nm of below 0.01 indicates that the impurity content is smaller, but unfavorably, it also indicates that there is a problem in crystallization of the titanyl phthalocyanine crystal. On the other hand, when the absorbance by the filtrate of light at a wavelength of 400 nm is above 0.08, impurities remaining in the titanyl phthalocyanine crystal may become greater, leading to deterioration of the sensitivity characteristics of the electrophotographic photoconductor.

Accordingly, the absorbance by the filtrate of light at a wavelength of 400 nm is more preferably in the range of 0.012 to 0.07, still more preferably in the range of 0.012 to 0.05.

The suspension described above is prepared as dispersed in an ultrasonic cleaning machine at a temperature of 23±3° C. for 1 hour.

The amount of the mixed solvent used in suspending the titanyl phthalocyanine crystal is 8 g (methanol: 4 g and N,N-dimethylformamide: 4 g).

The amount of the titanyl phthalocyanine crystal suspended is 0.1 g.

The filter used for filtration of the suspension is a PTFE-type membrane filter having an opening of 0.1 μm.

The thickness of the absorption layer (filtrate) during measurement of absorbance is 10 mm (cell length).

A possible mechanism that the sensitivity characteristics of the electrophotographic photoconductor is lowered by the impurities remaining in the titanyl phthalocyanine crystal is as follows:

A slight difference in the amount of the impurities remaining in the crystal seems to cause fluctuation in the interaction between the crystal and the photo sensitive layer application liquid, which, in turn, leads to deterioration of the dispersibility of the titanyl phthalocyanine crystal in the photo sensitive layer.

The absorbance of light at a wavelength of 400 nm is used as an indicator of impurities, because there has been observed an empirical relationship between the absorbance of the light at the wavelength and the dispersibility of the titanyl phthalocyanine crystal or the like.

(2)-2 Content

The content of the charge generating agent is preferably in the range of 0.1 to 50 parts by weight with respect to 100 parts by weight of the binding resin.

This is because adjusting the content of the charge generating agent in the range above enables further improvement of the dispersibility of the charge generating agent in the photo sensitive layer.

In other words, that is because, when the content of the charge generating agent is below 0.1 part by weight, the amount of the charge generated may become insufficient, making it difficult to form an electrostatic latent image on the photoconductor, while on the other hand, an addition amount of the charge generating agent at above 50 parts by weight may result in difficulty in dispersing the charge generating agent uniformly in the photo sensitive layer application liquid.

Accordingly, the content of the charge generating agent is more preferably in the range of 0.5 to 40 parts by weight, still more preferably in the range of 1 to 30 parts by weight, with respect to 100 parts by weight of the binding resin.

(3) Hole Transfer Agent (3)-1 Kind

The hole transfer agent for use in the present invention is not particularly limited, and any one of known various hole transfer compounds may be used. Favorable examples thereof for use include benzidine compounds, phenylenediamine compounds, naphthylenediamine compounds, phenanthrylenediamine compounds, oxadiazole compounds (e.g., 2,5-di(4-methylaminophenyl)-1,3,4-oxadiazole), styryl compounds (e.g., 9-(4-dimethylaminostyryl)anthracene), carbazole compounds (e.g., poly-N-vinylcarbazole), organic polysilane compounds, pyrazoline compounds (e.g., 1-phenyl-3-(p-dimethylaminophenyl)pyrazoline), hydrazone compounds, triphenylamine compounds, indole compounds, oxazole compounds, isoxazole compounds, thiazole compounds, thiadiazole compounds, imidazole compounds, pyrazole compounds, triazole compounds, butadiene compounds, pyrene hydrazone compounds, acrolein compounds, carbazole hydrazone compounds, quinoline hydrazone compounds, stilbene compounds, stilbene hydrazone compounds, and diphenylenediamine compounds. These compounds my be used alone or in combination of two or more.

More preferable is a triarylamine compound represented by Formula (1).

This is because, as will be described below in detail, with the compound having such a particular structure, it is possible to make clearer the relationship between the light-absorbing property of the photo sensitive layer and the dispersibility of the charge generating agent and further improve the sensitivity characteristics of the electrophotographic photoconductor.

That is, the compound having such a particular structure hardly absorbs the light in a wavelength range of 750 to 900 nm, which is important for the light-absorbing property of the photo sensitive layer. Thus, it has almost no influence on the light-absorbing property of the photo sensitive layer, as defined in the present invention.

On the other hand, the compound having such a particular structure has a favorable hole transfer rate because of its structure, easily improving the sensitivity characteristics.

(3)-2 Typical Examples

Typical examples of the triarylamine compounds represented by Formula (1) include compounds (HTM-1 to HTM-3) represented by the following Formulae (9) to (11).

(9)

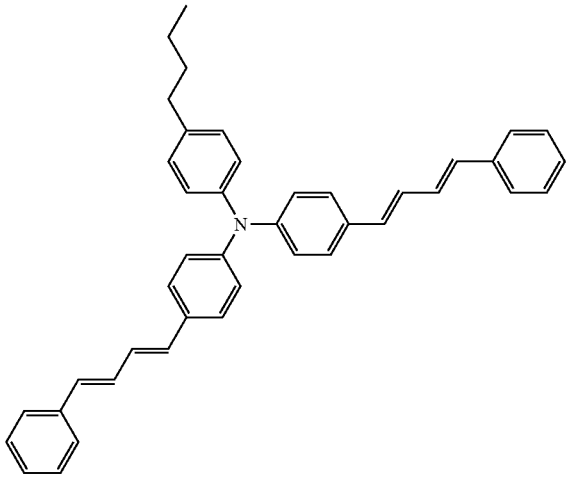

(HTM-1)

-continued (10)

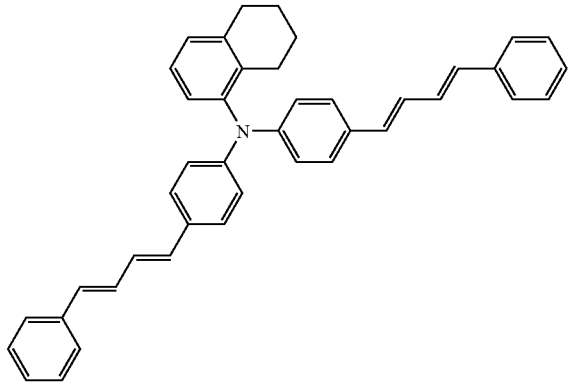

(HTM-2)

(11)

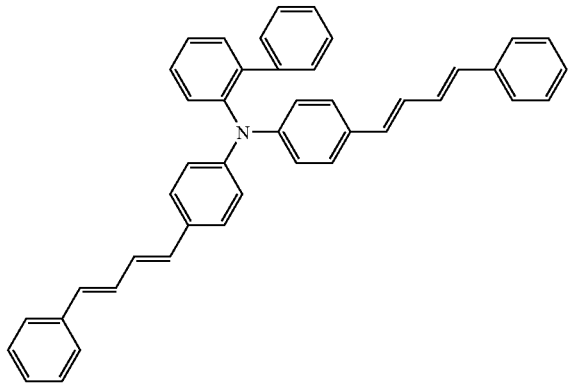

(HTM-3)

Other compounds favorably used include a compound (HTM-4) represented by the following Formula (12).

(12)

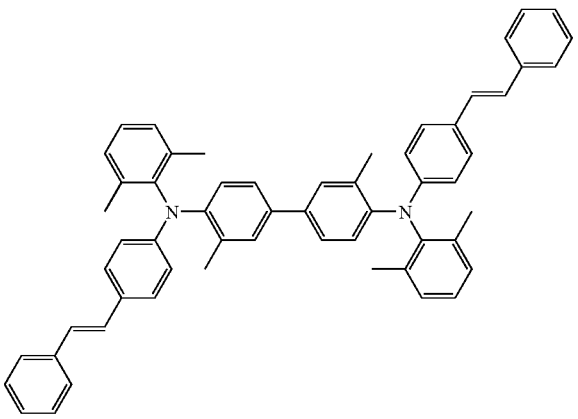

(HTM-4)

(3)-3 Content

The content of the hole transfer agent is preferably in the range of 1 to 120 parts by weight with respect to 100 parts by weight of the binding resin.

This is because an addition amount of the hole transfer agent at below 1 parts by weight may lead to drastic deterioration of the hole transfer ability of the photo sensitive layer, possibly showing an adverse effect on the image quality, while on the other hand, the content of the hole transfer agent exceeding 120 parts by weight may lead to deterioration in dispersibility, causing a problem of easier crystallization.

Accordingly, the addition amount of the hole transfer agent is more preferably in the range of 5 to 100 parts by weight and still more preferably in the range 10 to 90 parts by weight, with respect to 100 parts by weight of the binding resin.

(4) Electron Transfer Agent (4)-1 Kind

The electron transfer agent for use in the present invention is not particularly limited, and any one of known various electron transfer compounds may be used. Examples thereof favorably used include benzoquinone compounds, naphthoquinone compounds, anthraquinone compounds, diphenoquinone compounds, dinaphthoquinone compounds, naphthalenetetracarbodiimide compounds, fluorenone compounds, malononitrile compounds, thiopyran compounds, trinitrothioxanthone compounds, dinitroanthracene compounds, dinitroacridine compounds, nitroanthraquinone compounds, and dinitroanthraquinone compounds. These compounds may be used alone or in combination of two or more.

More favorable compounds include the compounds represented by Formulae (3) to (5).

This is because, with the compound having such a particular structure, it is possible to specify definitely the relationship between the light-absorbing property of the photo sensitive layer and the dispersibility of the charge generating agent, as will be described below in detail, and also to further improve the sensitivity characteristics of the electrophotographic photoconductor.

In other words, that is because the compound having such a particular structure hardly absorbs the light in a wavelength range of 750 to 900 nm which is important for the light-absorbing property of the photo sensitive layer, with the result that almost no influence occurs on the light-absorbing property of the photo sensitive layer as defined in the present invention, while on the other hand, the compound having such a particular structure has a favorable hole transfer rate because of its structure, easily improving the sensitivity characteristics.

(4)-2 Typical Examples

Typical examples of the dinaphthoquinone compounds represented by Formula (3) include the compound (ETM-1) represented by the following Formula (13); typical examples of the quinone compounds represented by Formula (4) include the compound (ETM-2) represented by the following Formula (14); and typical examples of the diphenoquinone compounds represented by Formula (5) include the compound (ETM-3) represented by the following Formula (15).

(13)

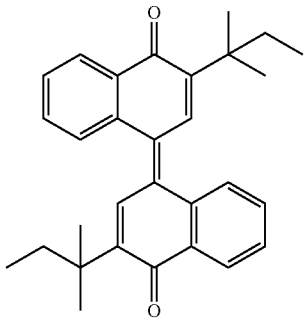

(ETM-1)

-continued (14)

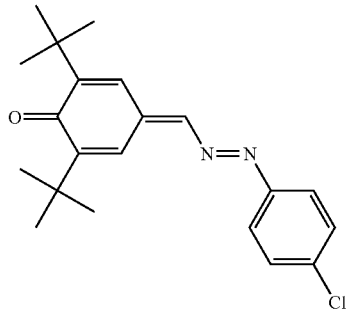

(ETM-2)

(15)

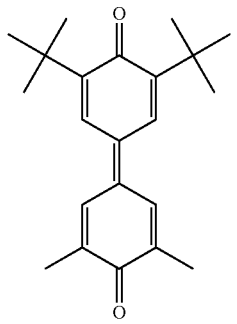

(ETM-3)

(4)-3 Content

The content of the electron transfer agent is preferably in the range of 1 to 120 parts by weight with respect to 100 parts by weight of the binding resin.

This is because the content of the electron transfer agent of below 1 part by weight may lead to drastic deterioration in the electron-transporting efficiency of the photo sensitive layer and also to adverse effects on the image quality, while on the other hand, the content of the electron transfer agent exceeding 120 parts by weight may lead to deterioration in dispersibility, causing a problem of easier crystallization.

Accordingly, the content of the electron transfer agent is more preferably in the range of 5 to 100 parts by weight, still more preferably in the range of 10 to 90 parts by weight, with respect to 100 parts by weight of the binding resin.

(5) Thickness

The thickness of the photo sensitive layer is preferably in the range of 5 to 100 μm.

This is because it is possible to make more definite the relationship between the light-absorbing property of the photo sensitive layer and the sensitivity characteristics of the electrophotographic photoconductor, as will be described below in detail, by adjusting the thickness of the photo sensitive layer in the range above.

Specifically, that is because a photo sensitive layer thickness of below 5 μm may make the relationship between the light-absorbing property of the photo sensitive layer and the sensitivity characteristics unclear and also make the mechanical strength of the photo sensitive layer insufficient, while on the other hand, a photo sensitive layer thickness of above 100 μm may make the influence by the binding resin and others excessively greater, which renders the relationship between the light-absorbing property of the photo sensitive layer and the sensitivity characteristics unclear and also renders the photo sensitive layer separate from the base body more easily or makes it difficult to form the photo sensitive layer uniformly.

It is thus preferable to adjust the thickness of the photo sensitive layer in the range of 10 to 80 μm, more preferably in the range of 20 to 40 μm.

(6) Light-Absorbing Property

In the present invention, the maximum absorption wavelength ($\lambda_{max}$) of the photo sensitive layer at a wavelength of 850 nm is characteristically controlled to be below 850 nm, and the absorbance ($A_{850}$) of light at a wavelength of 850 nm per unit thickness of the photo sensitive layer is characteristically controlled to be 0.05 ($\mu m^{-1}$) or less.

This is because it is possible to make the dispersibility of the charge generating agent in the photo sensitive layer favorable, by adjusting the maximum absorption wavelength of the photo sensitive layer in a predetermined range and the absorbance of the light at a predetermined wavelength per unit thickness of the photo sensitive layer in a predetermined range.

As a result, it is possible to easily determine the dispersibility of the charge generating agent that deteriorates easily for some reasons and the sensitivity characteristics of the electrophotography photoconductor that is significantly dependent thereon without actual measurement of the sensitivity characteristics, and thus, to obtain an electrophotography photoconductor superior in sensitivity characteristics reliably.

The dispersibility of the charge generating agent has close relationship with the sensitivity characteristics of the electrophotographic photoconductor, and it is known that the sensitivity characteristics of the electrophotographic photoconductor are improved when the dispersibility of the charge generating agent is better.

Hereinafter, the relationship between the light-absorbing property of the photo sensitive layer and the sensitivity characteristics of the electrophotographic photoconductor will be described more specifically.

The relationship between the absorption spectra per unit thickness of the photo sensitive layer and the sensitivity characteristics of the electrophotographic photoconductor will be described with reference to FIG. 1.

FIG. 1 is a characteristic curve (absorption spectra) wherein the wavelength (nm) is plotted on the abscissa, while the absorbance per unit thickness of the photo sensitive layer ($\mu m^{-1}$) is plotted on the ordinate.

The configuration of the photo sensitive layer, the conditions for measuring the absorbance, and others will be described in detail in the Examples below.

Here, the characteristic curves A to F are absorption spectra of photo sensitive layers different in the kinds of the charge generating agent, hole transfer agent and electron transfer agent, respectively as shown in Table 1 in detail.

The difference among the titanyl phthalocyanine crystals (TiOPc-A to TiOPc-C) used as a charge generating agent derives from the washing method of washing the titanyl phthalocyanine wet cake obtained in the step before preparation of the crystal. The respective washing methods will be described in the Examples below.

TABLE 1

| Photo sensitive layer | Charge generating agent | Hole transfer agent | Charge transfer agent |
|---|---|---|---|
| Characteristic curve A | TiOPc-A | HTM-4 | ETM-1 |
| Characteristic curve B | | HTM-1 | ETM-2 |
| Characteristic curve C | | HTM-2 | ETM-1 |
| Characteristic curve D | | | ETM-2 |

TABLE 1-continued

| Photo sensitive layer | Charge generating agent | Hole transfer agent | Charge transfer agent |
|---|---|---|---|
| Characteristic curve E | TiOPc-B | HTM-4 | ETM-1 |
| Characteristic curve F | TiOPc-C | | |

When characteristic curves A to F shown in FIG. 1 are grouped according to their shapes, they can be grouped into the following types (i) to (iii):

(i) Types corresponding to characteristic curves A to D

The characteristic curve corresponding to type (i) has a maximum absorption wavelength ($\lambda_{max}$) of about 800 nm.

The characteristic curves cross each other at a point close to a wavelength of about 850 nm, and the absorbance ($A_{850}$) per unit thickness then is approximately 0.045.

(ii) Type Corresponding to Characteristic Curve E

The characteristic curve corresponding to type (ii) has a general value of the absorbance per unit thickness and a maximum absorption wavelength ($\lambda_{max}$) similar to those of the type (i).

On the other hand, it is different in shape from the characteristic curve of type (i).

More specifically, the absorbance per unit thickness does not decline even at a wavelength of above 800 nm and begins to decline rapidly at a wavelength close to 840 nm.

(iii) Type Corresponding to Characteristic Curve F

The characteristic curve corresponding to type (iii) has a general value of the absorbance per unit thickness distinctively smaller than that of type (i) or (ii) and additionally a maximum absorption wavelength ($\lambda_{max}$) of above 850 nm.

The characteristic curve is also different in shape from that of type (i) or (ii) described above.

More specifically, the absorbance per unit thickness does not decline significantly even at a wavelength of above 850 nm and declines gradually at a wavelength of above about 860 nm.

The types (i) to (iii) described above respectively reflect the dispersibility of the charge generating agent in the photo sensitive layers. Accordingly, each photo sensitive layer classified in type (i) to (iii) is found to have a different sensitivity characteristics, based on the difference in dispersibility.

Specifically, the photo sensitive layer classified in type (i) is superior in sensitivity characteristics, but the photo sensitive layer classified in type (ii) or (iii) is insufficient in sensitivity characteristics.

More specifically, the photo sensitive layer classified in type (i), which is favorable in dispersion state of the charge generating agent, is superior in sensitivity characteristics.

On the other hand, the photo sensitive layer classified in type (ii), which is a mixture of the layers favorable and unfavorable in the dispersion state of the charge generating agent, is insufficient in sensitivity characteristics.

Further, the photo sensitive layer classified in type (iii), which is unfavorable in dispersion state of the charge generating agent, is lower in absorbance and insufficient in sensitivity characteristics.

The relationship between the absorption spectra per unit thickness of the photo sensitive layer (characteristic curve) and the sensitivity characteristics of the electrophotographic photoconductor described above are summarized in Table 2.

TABLE 2

| Photo sensitive layer | | Sensitivity characteristics | |
|---|---|---|---|
| | | Sensitivity (V) | Evaluation |
| Type (i) | Characteristic curve A | 119 | Favorable |
| | Characteristic curve B | 135 | |
| | Characteristic curve C | 123 | |
| | Characteristic curve D | 131 | |
| Type (ii) | Characteristic curve E | 172 | Unfavorable |
| Type (iii) | Characteristic curve F | 162 | |

As described above, the photo sensitive layers can be classified into three types according to the light-absorbing property of the photo sensitive layer, and it is found that the type (i) is superior in sensitivity characteristics among the three types.

That is, the parameter defined in the present invention is obtained as a result of defining the type (i) photo sensitive layer with the light-absorbing property. Hereinafter, the parameter will be described.

First, the relationship between the maximum absorption wavelength of the photo sensitive layer and the sensitivity characteristics of the electrophotographic photoconductor will be described with reference to FIG. 3.

The reason for adopting a maximum absorption wavelength ($\lambda_{max}$) of the photo sensitive layer at a wavelength of below 850 nm in the present invention will be described first.

Figure 3:
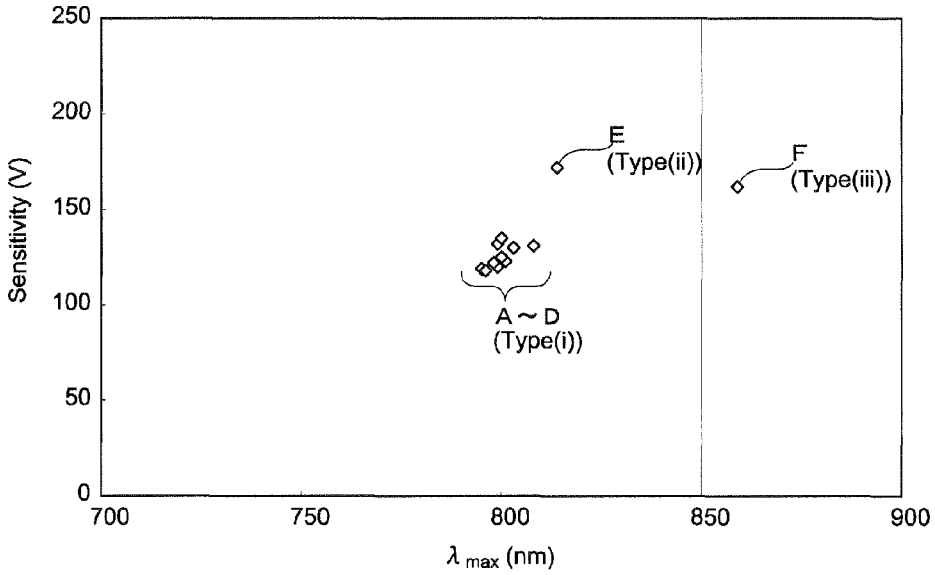
FIG. 3 is a scatter diagram showing the relationship between a maximum absorption wavelength ($\lambda_{max}$) and a sensitivity of the photo sensitive layer.

FIG. 3 is a scatter diagram wherein the maximum absorption wavelength ($\lambda_{max}$) of the photo sensitive layer (nm) is plotted on the abscissa, while the sensitivity (V) of the corresponding electrophotographic photoconductor is plotted on the ordinate.

The configuration of the photo sensitive layer, the conditions for measuring the absorbance and sensitivity will be described in detail in Examples below.

Markers A to F respectively correspond to the photo sensitive layers represented by the characteristic curves A to F respectively shown in FIG. 1 and Table 1.

As obvious from the scatter diagram, markers A to D corresponding to type (i) have a low sensitivity of about 130 V, indicating favorable sensitivity characteristics.

On the other hand, the markers E and F corresponding to types (ii) and (iii) have a high sensitivity of 150 V or more, indicating unfavorable sensitivity characteristics.

As obvious from the scatter diagram, the maximum absorption wavelength ($\lambda_{max}$) of the marker A to E is a value of around 800 nm, while the maximum absorption wavelength ($\lambda_{max}$) of the marker F is a value of around 860 nm.

It is thus possible to remove type (iii) photo sensitive layer, to which the marker F belongs effectively, by making the maximum absorption wavelength ($\lambda_{max}$) smaller than 850 nm.

Hereinafter, the relationship between the absorbance of light at a wavelength of 850 nm per unit thickness and the sensitivity characteristics of the electrophotographic photoconductor will be described with reference to FIG. 4.

The reason for setting the absorbance ($A_{850}$) of light at a wavelength of 850 nm per unit thickness to 0.05 $\mu m^{-1}$ or less in the present invention will be described.

Figure 4:
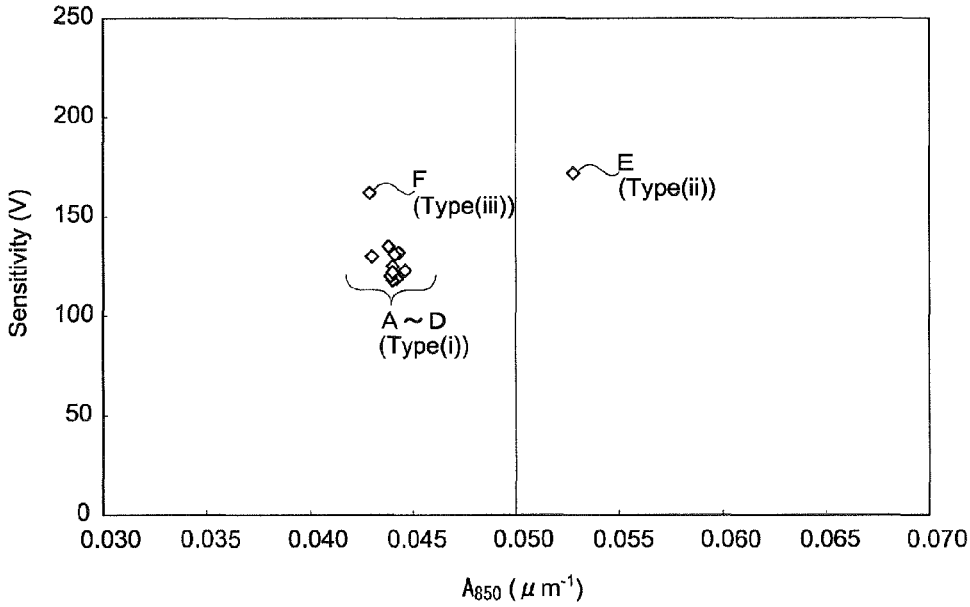
FIG. 4 is a scatter diagram showing the relationship between an absorbance ($A_{850}$) of light at a wavelength of 850 nm per unit thickness and the sensitivity.

FIG. 4 is a scatter diagram wherein the absorbance ($A_{850}$) of light at a wavelength of 850 nm per unit thickness ($\mu m^{-1}$)

is plotted on the abscissa, while the sensitivity (V) of the corresponding electrophotographic photoconductor is plotted on the ordinate.

The configuration of the photo sensitive layer, the conditions for measuring the absorbance and sensitivity, and also the markers A to F are the same as those described above in FIG. 3.

As obvious from the scatter diagram, the absorbances ($A_{850}$) per unit thickness of the markers A to D and F are smaller than 0.045 $\mu m^{-1}$, while the absorbance ($A_{850}$) per unit thickness of the marker E is about 0.053 $\mu m^{-1}$.

It is thus possible to remove the type (ii) photo sensitive layer, to which the marker E belongs, by setting an absorbance ($A_{850}$) per unit thickness of light at a wavelength of 850 nm to be not larger than 0.05 $\mu m^{-1}$.

As described above in detail, it is possible to identify a type (i) photo sensitive layer superior in sensitivity easily by controlling the maximum absorption wavelength ($\lambda_{max}$) of the photo sensitive layer to be below 850 nm and the absorbance ($A_{850}$) of light at a wavelength of 850 nm per unit thickness of the photo sensitive layer to be 0.05 $\mu m^{-1}$ or less.

Thus, to obtain a type (i) photo sensitive layer more reliably, the maximum absorption wavelength ($\lambda_{max}$) of the photo sensitive layer is more preferably adjusted into the range of 750 to 830 nm, still more preferably into the range of 780 to 810 nm.

Alternatively, the absorbance ($A_{850}$) of light at a wavelength of 850 nm per unit thickness is more preferably adjusted into the range of 0.04 to 0.048 $\mu m^{-1}$, still more preferably into the range of 0.042 to 0.045 $\mu m^{1}$.

The maximum absorption wavelength ($\lambda_{max}$) of the photo sensitive layer and the absorbance ($A_{850}$) of light at a wavelength of 850 nm per unit thickness preferably satisfy the following relationship formula (1).

$$16 \leq \lambda_{max}/A_{850}(1\times10^{-12}\ m^2) \leq 20 \quad (1)$$

This is because, when the maximum absorption wavelength ($\lambda_{max}$) and the absorbance ($A_{850}$) of light at a wavelength of 850 nm per unit thickness satisfy the relationship formula (1), it is possible to make the dispersibility of the charge generating agent in the photo sensitive layer better.

Specifically when $\lambda_{max}/A_{850}$ is smaller than $16\times10^{-12}$ $m^2$, the dispersibility of the charge generating agent in the photo sensitive layer becomes closer to the type (ii) condition described above, often resulting in excessive deterioration in sensitivity characteristics. On the other hand, when $\lambda_{max}/A_{850}$ is above $20\times10^{-12}$ $m^2$, the dispersibility of the charge generating agent in the photo sensitive layer becomes closer to the type (iii) condition described above, occasionally resulting in excessive deterioration in sensitivity characteristics.

Accordingly, the maximum absorption wavelength ($\lambda_{max}$) of the photo sensitive layer and the absorbance ($A_{850}$) of light at a wavelength of 850 nm per unit thickness more preferably satisfy the following relationship formula (1'), still more preferably the following relationship formula (1").

$$17 \leq \lambda_{max}/A_{850}(1\times10^{-12}\ m^2) \leq 19.5 \quad (1')$$

$$16 \leq \lambda_{max}/A_{850}(1\times10^{-12}\ m^2) \leq 19 \quad (1'')$$

An example of calculation of $\lambda_{max}/A_{850}$ (when, $\lambda_{max}$=850 nm, and $A_{850}$=0.05 $\mu m^{-1}$) is shown below.

$$\lambda_{max}/A_{850} = 850\ nm/0.05\ \mu m^{-1}$$
$$= 850\times10^{-9}m/0.05(1/\mu m)$$

-continued $$= 850\times10^{-9}m/0.05\times10^{6}(1/m)$$
$$= 850/0.05\times(10^{-16}m^2)$$
$$= 17000\times(10^{-16}m^2)$$
$$= 1.7\times(10^{-11}m^2)$$
$$= 17\times(1\times10^{-12}m^2)$$

The relationship between $\lambda_{max}/A_{850}$ described above and the sensitivity characteristics of the electrophotographic photoconductor will be described next with reference to FIG. 5.

Figure 5:
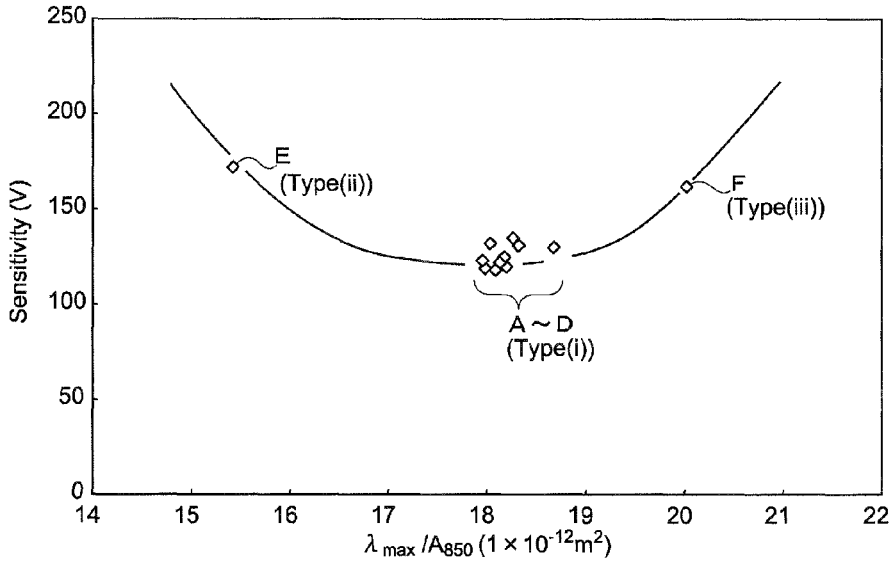
FIG. 5 is a graph showing the relationship between $\lambda_{max}/A_{850}$ and the sensitivity.

FIG. 5 is a characteristic curve wherein $\lambda_{max}/A_{850}$ ($1\times10^{-12}$ $m^2$) is plotted on the abscissa and the sensitivity (V) of the corresponding electrophotographic photoconductor is plotted on the ordinate.

The configuration of the photo sensitive layer, the conditions for measuring the absorbance and sensitivity, and also the markers A to F are the same as those described above in FIGS. 3 and 4.

As obvious from the characteristic curve, the value of $\lambda_{max}/A_{850}$ and the sensitivity have a distinct relationship with each other.

The sensitivity decreases as $\lambda_{max}/A_{850}$ increases when it is in the range of below $16\times10^{-12}$ $m^2$, but the sensitivity is a high value of 150 V or more, indicating that sufficient sensitivity characteristics is not obtained.

On the other hand, the sensitivity is around 130 V, independently of $\lambda_{max}/A_{850}$ when it is in the range of $16\times10^{-12}$ to $20\times10^{-12}$ $m^2$, indicating that superior sensitivity characteristics is obtained.

The sensitivity increases continuously to a value of 150 V or more with increase of $\lambda_{max}/A_{850}$ until it increases into the range of above $20\times10^{-12}$ $m^2$.

As obvious from the positions of respective markers in the characteristic curve, the photo sensitive layer having a $\lambda_{max}/A_{850}$ in the range of below $16\times10^{-12}$ $m^2$ is the type (ii) photo sensitive layer to which the marker E belongs; that having a $\lambda_{max}/A_{850}$ in the range of $16\times10^{-12}$ to $20\times10^{-12}$ $m^2$ is the type (i) photo sensitive layer to which the markers A to D belong; and that having a $\lambda_{max}/A_{850}$ in the range of above $20\times10^{-12}$ $m^2$ is the type (iii) photo sensitive layer to which the marker B belongs.

The absorbance ($A_{780}$) of light at a wavelength of 780 nm per unit thickness of the photo sensitive layer is preferably set to a value of 0.045 $\mu m^{-1}$ or more.

This is because the sensitivity characteristics to the light at a wavelength actually irradiated can be effectively improved by adjusting the absorbance of light at the wavelength per unit thickness in the range above.

In other words, that is because, when the absorbance ($A_{780}$) of light at a wavelength of 780 nm per unit thickness is a value of below 0.05 $\mu m^{-1}$, it is occasionally difficult to obtain sufficient sensitivity characteristics, for example, because of an extremely low content of the charge generating agent even if the light-absorbing property specified in the present invention is satisfied, while on the other hand, when the absorbance ($A_{780}$) of light at a wavelength of 780 nm per unit thickness is too large, it may be difficult to satisfy the light-absorbing property specified in the present invention.

Thus, the absorbance ($A_{780}$) of light at a wavelength of 780 nm per unit thickness of the photo sensitive layer is more preferably adjusted into the range of 0.05 to 0.07 $\mu m^{-1}$, still more preferably into the range of 0.055 to 0.065 $\mu m^{-1}$.

(7) Production Method

The method of producing a monolayer type photoconductor is not particularly limited, but it can be produced, for example, by the following procedure.

First, a charge generating agent, a charge transfer agent, a binding resin, an additive and the like are dispersed in a solvent to give an application liquid. The application liquid thus obtained is coated on a conductive base body (simple aluminum tube) by a method such as dip coating, spray coating, bead coating, blade coating or roller coating.

The base body is then dried with hot air, for example, under a condition of 100° C. for 30 minutes, to give a monolayer type photoconductor having a photo sensitive layer of a predetermined film thickness.

Various organic solvents are usable as the solvents for the dispersion, and examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethylether, diethylether, tetrahydrofuran, ethylene glycol dimethylether, diethylene glycol dimethylether, 1,3-dioxolane, and 1,4-dioxane; ketones such as acetone, methylethylketone and cyclohexanone; esters such as ethyl acetate and methyl acetate; dimethyl formaldehyde, dimethylformamide, and dimethylsulfoxide. These solvents may be used alone or as a mixture of two or more. In this case, surfactants, leveling agents and the like may be added thereto, for improvement in the dispersibility of the charge generating agent and the surface smoothness of the photoconductor layer.

An intermediate layer is also preferably formed on the base body before formation of the photo sensitive layer.

In forming the intermediate layer, a binding resin and as needed, an additive (organic fine powder or inorganic fine powder) are dispersed together with a suitable dispersion medium by a conventional means such as a roll mill, a ball mill, an attriter, a paint shaker, or an ultrasonic dispersing machine, to give an application liquid. The application liquid is then coated by a known method such as blade coating, immersing coating, or spraying coating and heated, to give an intermediate layer.

Various additives (organic fine powder or inorganic fine powder) may be added in small amounts in the range that does not cause problems such as sedimentation during production, for example, for prevention of the interference fringes by light scattering.

Then, the application liquid obtained is coated, for example, on a supporting base body (simple aluminum tube) by a known preparation method such as dip coating, spray coating, bead coating, blade coating, or roller coating.

Then, the application liquid applied on the base body is preferably dried at a temperature of 20 to 200° C. for a period in the range of 5 minute to 2 hours.

Various organic solvents may be used as the solvents for the application liquid, and examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride, and chlorobenzene; ketones such as acetone, methylethylketone and cyclohexanone; esters such as ethyl acetate and methyl acetate; dimethyl formaldehyde, dimethylformamide, and dimethylsulfoxide. These solvents may be used alone or as a mixture of two or more.

(8) Preparative Method for Titanyl Phthalocyanine Crystal

In the present invention, when a titanyl phthalocyanine crystal is used as a charge generating agent, the titanyl phthalocyanine crystal is preferably prepared in a production method including the following steps (a) to (d):

(a) a step of dissolving a crude titanyl phthalocyanine crystal in an acid to obtain a titanyl phthalocyanine solution;

(b) a step of adding the titanyl phthalocyanine solution dropwise into a poor solvent to obtain a wet cake;

(c) a step of washing the wet cake with an alcohol having 1 to 4 carbon atoms; and (d) a step of heating and agitating the washed wet cake in a nonaqueous solvent to obtain a titanyl phthalocyanine crystal.

Hereinafter, the production method for a titanyl phthalocyanine crystal preparation of will be described.

(8)-1 Preparation of Titanyl Phthalocyanine Compound

The production method for the titanyl phthalocyanine compound is not particularly limited, and any one of conventional methods of producing titanyl phthalocyanine compounds may be used.

By way of example, specific description will be given of a method of producing a titanyl phthalocyanine compound represented by Formula (8) having the following thermal properties that is suitable for obtaining the titanyl phthalocyanine compound.

More specifically, detailed description will be given of a method of producing a titanyl phthalocyanine crystal that characteristically has no peak in the range of 50 to 270° C. except the peak due to vaporization of adsorbed water and one peak in the range of 270 to 400° C. in differential scanning calorimetry.

It is preferable to prepare the titanyl phthalocyanine compound by reaction of o-phthalonitrile or a derivative thereof, or 1,3-diiminoisoindolineoraderivative thereof (a raw material for the titanyl phthalocyanine compound) with a titanium alkoxide or titanium tetrachloride in the presence of a urea compound.

That is, it is preferably prepared according to the following reaction formula (1) or (2). In reaction formulae (1) and (2), titanium tetrabutoxide represented by Formula (17) is used, for example, as the titanium alkoxide.

(i) Reaction Formula

Therefore, it is preferable to prepare the titanyl phthalocyanine compound (CGM-1) represented by Formula (8), in reaction of o-phthalonitrile represented by Formula (16) with titanium tetrabutoxide as the titanium alkoxide represented by Formula (17) as shown in reaction formula (1), or in reaction of 1,3-diaminoisoindoline represented by Formula (18) with titanium alkoxide such as titanium tetrabutoxide represented by Formula (17) as shown in reaction formula (2).

Alternatively, titanium tetrachloride may be used, replacing the titanium alkoxide such as titanium tetrabutoxide represented by Formula (17).

Reaction formula (1)

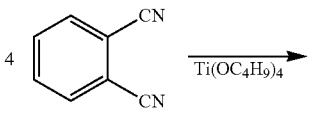

(16) (17)

-continued

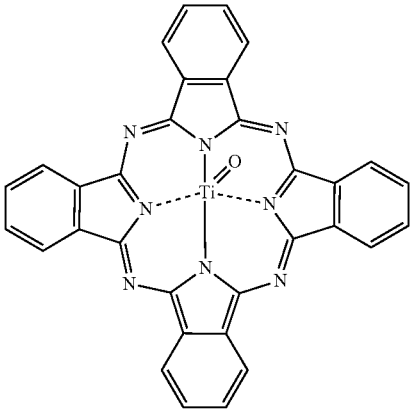

(CGM-1)
(8)

Reaction formula (2)

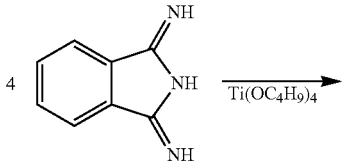

(18) (17)

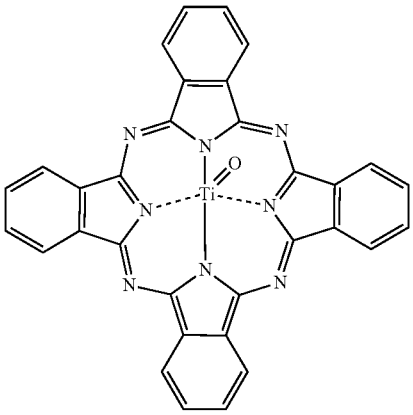

(CGM-1)
(8)

(ii) Addition Amount

The addition amount of the titanium alkoxide such as titanium tetrabutoxide represented by Formula (17) or titanium tetrachloride is preferably in the range of 0.40 to 0.53 mole with respect to 1 mole of o-phthalonitrile represented by Formula (16) or a derivative thereof, or 1,3-diaminoisoindoline represented by Formula (18) or a derivative thereof.

This is because an excessive addition amount of the titanium alkoxide such as titanium tetrabutoxide represented by Formula (17) or titanium tetrachloride of ¼ mole equivalence or more with respect to o-phthalonitrile represented by Formula (16) or a derivative thereof, or 1,3-diaminoisoindoline represented by Formula (18) or a derivative thereof is effective in increasing the interaction with the urea compound described below. The interaction will be described below specifically in the section of the urea compound.

Accordingly, the addition amount of the titanium alkoxide such as titanium tetrabutoxide represented by Formula (17) or titanium tetrachloride is more preferably in the range of 0.43 to 0.50 mole, still more preferably in the range of 0.45 to 0.47 mole, with respect to 1 mole of o-phthalonitrile represented by Formula (16), 1,3-diaminoisoindoline represented by Formula (18).

(iii) Urea Compound

The reactions represented by reaction formulae (1) and (2) described above are preferably carried out in the presence of a urea compound. This is because, when the titanyl phthalocyanine compound prepared in the presence of a urea compound is used, it is possible to obtain a specific titanyl phthalocyanine crystal efficiently because of the interaction between the urea compound and the titanium alkoxide or titanium tetrachloride.

The interaction is an action to accelerate the reactions represented by reaction formulae (1) and (2), by a substance, a complex formed by complexation of ammonia generated in reaction of the urea compound with a titanium alkoxide or titanium tetrachloride with the titanium alkoxide or titanium tetrachloride. It is thus possible to produce a titanyl phthalocyanine crystal resistant to crystal transition even in organic solvent, by carrying out the reaction of the raw substances under the acceleration action.

(iii)-1 Kind

The urea compound used in reaction formulae (1) and (2) is preferably at least one compound selected from the group consisting of urea, thiourea, O-methylisourea sulfate salt, O-methylisourea carbonate salt, and O-methylisourea hydrochloride salt.

This is because, when such a urea compound is used as the urea compound in the reaction formulae (1) and (2), ammonia generated in the reaction process complexes with the titanium alkoxide or titanium tetrachloride more efficiently and the complex thus formed further accelerates the reaction represented by the reaction formulae (1) and (2).

Specifically, ammonia generated in reaction of the raw substance titanium alkoxide or titanium tetrachloride and the urea compound more efficiently forms a complex compound, for example, with the titanium alkoxide. The complex compound further accelerates the reaction represented by the reaction formulae (1) and (2).

It is known that the complex compound is formed specifically when the reaction is carried out at a high temperature of 180° C. or higher. For that reason, it is more effective to carry out the reaction in a nitrogen-containing compound having a boiling point of 180° C. or higher, such as quinoline (boiling point: 237.1° C.), isoquinoline (boiling point: 242.5° C.), or a mixture thereof (weight ratio 10:90 to 90:10).

Among the urea compounds described above, urea is more preferably used because it gives ammonia as the reaction accelerator and the resulting complex compound further more easily.

(iii)-2 Addition Amount

The addition amount of the urea compound used in the reaction formulae (1) and (2) is preferably in the range of 0.1 to 0.95 mole with respect to 1 mole of o-phthalonitrile or a derivative thereof, or 1,3-diaminoisoindoline or a derivative thereof.

This is because it is possible to increase the action of the urea compound described above more efficiently by controlling the addition amount of the urea compound in the range above.

The addition amount of the urea compound is more preferably in the range of 0.2 to 0.8 mole, still more preferably in the range of 0.3 to 0.7 mole, with respect to 1 mole of o-phthalonitrile or a derivative thereof, or 1,3-diaminoisoindoline or a derivative thereof.

(iv) Solvent

The solvent for use in the reaction formulae (1) and (2) is, for example, a solvent or a mixed solvent of two or more selected from the group consisting of hydrocarbon solvents such as xylene, naphthalene, methylnaphthalene, tetralin, and nitrobenzene; halogenated hydrocarbon solvents such as dichlorobenzene, trichlorobenzene, dibromobenzene, and chloronaphthalene; alcoholic solvents such as hexanol, octanol, decanol, benzylalcohol, ethylene glycol, and diethylene glycol; ketone solvents such as cyclohexanone, acetophenone, 1-methyl-2-pyrrolidone, and 1,3-dimethyl-2-imidazolidinone; amide solvents such as formamide and acetamide; and nitrogen-containing solvents such as picoline, quinoline, and isoquinoline.

In particular, nitrogen-containing compounds having a boiling point of 180° C. or higher, such as quinoline and isoquinoline, are favorable because ammonia generated in reaction of titanium alkoxide or titanium tetrachloride the raw substance with the urea compound forms complex compounds, for example, with the titanium alkoxide more efficiently.

(v) Reaction Temperature

The reaction temperature in the reaction formulae (1) and (2) is preferably higher at 150° C. or more. This is because, when the reaction temperature is lower than 150° C., especially 135° C. or lower, titanium alkoxide or titanium tetrachloride as the raw substance is made to react with the urea compound to make it difficult to form complex compounds. Therefore, this is because the acceleration of the reaction represented by the reaction formulae (1) and (2) by the complex compound becomes more difficult, making it difficult to produce a titanyl phthalocyanine crystal resistant to crystal transition even in an organic solvent.

Accordingly, the reaction temperature in the reaction formulae (1) and (2) is more preferably in the range of 180 to 250° C., still more preferably in the range of 200 to 240° C.

(vi) Reaction Time

The reaction time in the reaction formulae (1) and (2) is preferably in the range of 0.5 to 10 hours, although it depends on the reaction temperature. This is because a reaction time of shorter than 0.5 hour results in difficulty of the reaction of the raw substance titanium alkoxide or titanium tetrachloride with the urea compound, inhibiting complex compound formation. It also inhibits acceleration of the reaction represented by the reaction formulae (1) and (2) by the complex compound, making it difficult to produce the titanyl phthalocyanine crystal resistant to crystal transition in an organic solvent efficiently. On the other hand, a reaction time of longer than 10 hours may lead to economical disadvantage or decrease in the amount of the complex compound generated.

Therefore, the reaction time in the reaction formulae (1) and (2) is more preferably in the range of 0.6 to 3.5 hours, still more preferably in the range of 0.8 to 3 hours.

(8)-2 Preparative Method for Titanyl Phthalocyanine Crystal i) Acid Pretreatment Step Subsequently, it is preferable to carry out, as a pretreatment process of the titanyl phthalocyanine compound, an acid treatment step of adding the titanyl phthalocyanine compound prepared in the step described above or in other step to a water-soluble organic solvent, stirring it under heat for a certain period, and stabilizing the solution by leaving the solution for a certain period at a temperature lower than that during stirring.

The water-soluble organic solvent for use in the acid pretreatment step is, for example, a solvent or a mixture of two or more of alcohols such as methanol, ethanol, and isopropanol; N,N-dimethylformamide, N,N-dimethylacetamide, propionic acid, acetic acid, N-methylpyrrolidone, and ethylene glycol. The water-soluble organic solvent may contain a small amount of an additional water-insoluble organic solvent.

The stirring condition in the acid pretreatment step is not particularly limited, but a stirring treatment at a temperature in the range of approximately 70 to 200° C. for about 1 to 3 hours is preferable.

The stabilization condition after the stirring treatment is also not particularly limited, but preferable is stabilization of the solution at a temperature in the range of approximately 10 to 50° C., particularly preferably at around 23±1° C., for about 5 to 15 hours. Processing in the acid pretreatment step gives a crude titanyl phthalocyanine crystal.

(ii) Acid Processing Process

Subsequently, in the acid processing process, the crude titanyl phthalocyanine crystal is preferably dissolved in an acid, to give a titanyl phthalocyanine solution.

This is because solubilization of the crude titanyl phthalocyanine crystal in an acid allows sufficiently decomposition of the impurities derived from the residual substances in production of the titanyl phthalocyanine compound.

The acid for use is preferably at least one acid selected from the group consisting of concentrated sulfuric acid, trifluoroacetic acid, and sulfonic acid.

This is because such an acid decomposes the above-described impurities more effectively and yet, suppresses decomposition of the titanyl phthalocyanine compound effectively, and also because after the acid treatment, the component derived from the acid can be removed easily by washing as described below.

The acid processing process is preferably carried out under the condition generally at 0 to 10° C. for 0.5 to 3.0 hours although is depends on the acid used.

(iii) Dropwise Addition Step

Subsequently, the titanyl phthalocyanine solution obtained in the acid processing process is preferably added dropwise into a poor solvent, to give a wet cake.

This is because dropwise addition of the titanyl phthalocyanine solution into a poor solvent effectively exhibits the washing efficiency in the following washing step.

The wet cake of the titanyl phthalocyanine compound obtained by precipitation by dropwise addition, which is in an amorphous shape having a greater surface area, releases its impurities effectively in the following washing step.

The poor solvent for use is preferably water.

This is because use of water is advantageous in precipitating the titanyl phthalocyanine compound easily from the viewpoint of its polarity and easiness of temperature control.

It is thus possible to increase the surface area of the wet cake of the precipitated titanyl phthalocyanine compound and remove the impurities therein more effectively.

The other poor solvent for use may be methanol, ethanol, a methanol/water mixed solvent, an ethanol/water mixed solvent, or the like.

The temperature of the poor solvent may vary according to the poor solvent used, but is generally, preferably in the range of 0 to 20° C.

(iv) Washing Step

The wet cake of the titanyl phthalocyanine compound obtained in the dropwise addition step is then, preferably washed with an alcohol having 1 to 4 carbon atoms.

This is because it is possible to dissolve and remove impurities having an absorption peak at a wavelength of 400 nm effectively with an alcohol having 1 to 4 carbon atoms.

The impurities in the condition as decomposed in the acid processing process described above are known empirically to have an absorption peak of light at a wavelength of 400 nm, but the impurities can be eluted effectively with a low-molecular weight alcohol having 1 to 4 carbon atoms.

The alcohol having 1 to 4 carbon atoms is preferably at least one alcohol selected from the group consisting of methanol, ethanol and 1-propanol.

This is because these alcohols allow the impurities having an absorption peak of light at a wavelength of 400 nm to be eluted and removed more effectively.

(v) Crystal-Form Transition Step

Preferably, the washed wet cake obtained in the washing step is then agitated under heat in a nonaqueous solvent, to give a titanyl phthalocyanine crystal.

This is because agitation under heat of the wet cake of the titanyl phthalocyanine in a nonaqueous solvent allows transition of the crystal into a specific crystal form having predetermined optical properties.

The above-described agitation under heat is preferably performed by dispersing the wet cake in an nonaqueous solvent in the presence of water and agitating the mixture at 30 to 70° C. for 5 to 40 hours.

The nonaqueous solvent is, for example, a halogenated solvent such as chlorobenzene and dichloromethane.

Second Embodiment

A second embodiment of the present invention is an image forming device having the monolayer type photoconductor described in the first embodiment and additionally electrification means, exposure means, developing means and transfer means placed around the monolayer type photoconductor, the image forming device operating at a process speed of 100 mm/sec or more.

Hereinafter, components different from those described in the first embodiment will be mainly described.

Figure 6:
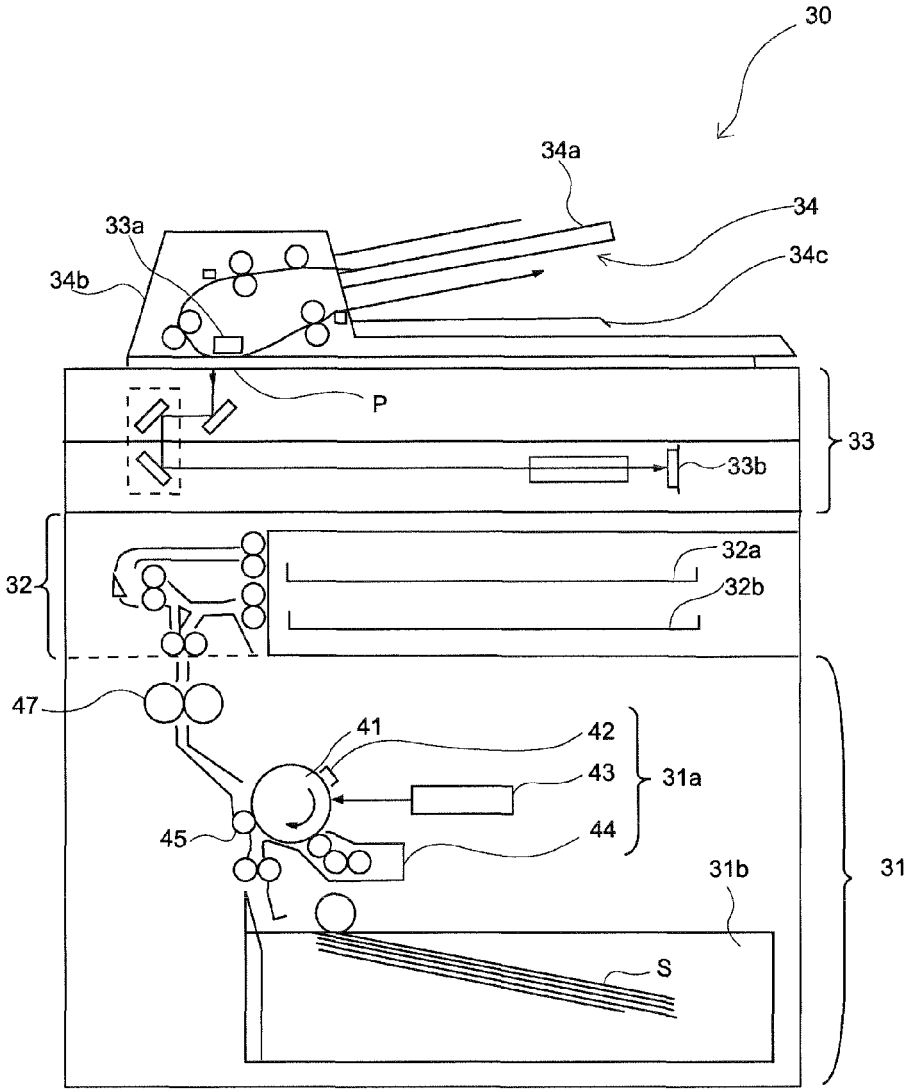
FIG. 6 is a view illustrating the configuration of an image forming device according to the present invention.

The image forming device in the second embodiment is configured as, for example, a copying machine 30 shown in FIG. 6. The copying machine 30 has an image forming unit 31, a paper ejection unit 32, an image reading unit 33, and an original feeding unit 34. The image forming unit 31 further has an image forming portion 31*a* and a paper feeding portion 31*b*. As exemplified, the original feeding unit 34 has an original mounting platen 34*a*, an original feeding mechanism 34*b*, and an original discharge tray 34*c*. An original placed on the original mounting platen 34*a* is fed by the original feeding mechanism 34*b* to an original reading position P, and then, discharged into the original discharge tray 34*c*.

When the original is sent to the original reading position P, an image on the original is read by the image reading unit 33 with the light from its light source 33*a*. Specifically, an image signal corresponding to the image on the original is formed by using an optical element 33*b* such as a charge coupled device (CCD).

On the other hand, recording sheets S (hereinafter, referred to simply as paper) piled on the paper feeding portion 31*b* are sent to the image forming portion 31*a* one by one. The image forming portion 31*a* has a photoconductor drum 41 as an image support body. Additionally, a charger 42, an exposure device 43, a developing device 44, and a transfer roller 45 are placed around the photoconductor drum 41 in the rotation direction of the photoconductor drum 41.

Among these components, the photoconductor drum 41 is rotated in the direction indicated by the solid line in the figure so as to be charged uniformly on its surface by the charger 42. The photoconductor drum 41 is then photo irradiated by the exposure device 43 based on the image signal described above to form an electrostatic latent image on the surface of the photoconductor drum 41.

The electrostatic latent image is then developed with a toner in the developing device 44 to form a toner image on the surface of the photoconductor drum 41. The toner image is then transferred as a transfer image onto the sheet S fed into a nip area between the photoconductor drum 41 and the transfer roller 45. The sheet S carrying the transfer image is then fed into the fixing unit 47, where the sheet S is subjected to fixing process.

The photoconductor drum 41 for use is characteristically the electrophotographic photoconductor described in the first embodiment.

The sheet S after fixation is then sent to the paper ejection unit 32. If after treatment (e.g., stapling, etc.) is needed, the sheet S is first sent to an intermediate tray 32*a* for after treatment. Then, the sheet S is discharged into an ejection tray portion (not shown) installed next to the side wall of the image forming device. On the other hand, the sheet S is discharged into a paper ejection tray 32*b* provided below the intermediate tray 32*a* if no after treatment is needed. The intermediate tray 32*a* and the paper ejection tray 32*b* are so-called housed paper ejection parts.

The image forming device according to the present invention is characteristically operated at a process speed of 100 mm/sec or more.

This is because, in the present invention, it is possible to form a high-quality image even at an accelerated process speed since the monolayer type photoconductor mounted is superior in sensitivity characteristics.

On the other hand, an excessively higher process speed may lead to fluctuation in electrostatic potential and also to easier generation of an exposure memory.

It is thus preferable to adjust the process speed in the range of 100 to 200 mm/sec, more preferably in the range of 110 to 150 mm/sec.

EXAMPLES

Hereinafter, the present invention will be described in details with reference to Examples.

Example 1

1. Preparation of Titanyl Phthalocyanine Compound 22 g (0.17 mol) of o-phthalonitrile, 25 g (0.073 mol) of titanium tetrabutoxide, 300 g of quinoline, and 2.28 g (0.038 mol) of urea were placed in an argon-substituted flask, and the mixture was heated to 150° C. while stirred.

The mixture was then heated to 215° C. while removing the vapor generated from the reaction system outside the system, and allowed to react at the same temperature while stirred for 2 hours.

After reaction, the reaction mixture was cooled to 150° C., removed from the flask, and filtered through a glass filter, and the solid obtained was washed with N,N-dimethylformamide and methanol sequentially and dried under vacuum, to give 24 g of a blue purple solid.

2. Preparation of Titanyl Phthalocyanine Crystal (1) Pigmentation Pretreatment 12 g of the blue purple solid obtained in the preparation of the titanyl phthalocyanine compound described above was added to 100 ml of N,N-dimethylformamide, and the mixture was heated to 130° C. while stirred and agitated for 2 hours.

After 2 hours, heating was terminated, agitation was also terminated when the mixture was cooled to 23±1° C., and the solution was left still under the condition for 12 hours for stabilizing treatment. The supernatant liquid after stabilization was filtered through a glass filter, and the solid obtained was washed with methanol and dried under vacuum, to give 11.8 g of a crude titanyl phthalocyanine compound crystal.

(2) Pigmentation Treatment 10 g of the titanyl phthalocyanine crude crystal obtained in the pigmentation pretreatment described above was dissolved in 100 g of 97% concentrated sulfuric acid. The acid treatment was performed at 5° C. for 1 hour.

Then, the solution was added dropwise into 5 l of ice-cooled purified water at a rate of 10 ml per minute, and the resulting mixture was agitated at around 15±3° C. for 30 minutes and then, left still for 30 minutes. The solution was then filtered through a glass filter, to give a wet cake.

The wet cake obtained was then resuspended and washed in 500 ml of in ethanol, and the methanol after washing was separated with a glass filter. The wet cake was washed four times. The wet cake obtained was then resuspended in 500 ml of purified water at 20° C., and the water after washing was filtered with a glass filter.

Subsequently, 5 g of the wet cake after washing was added to 0.75 g of water and 100 g of chlorobenzene, and the mixture was agitated additionally at 50° C. for 24 hours under heat.

The crystal obtained by separating the supernatant liquid with a glass filter was washed in the funnel with 100 ml of methanol and dried under vacuum at 50° C. for 5 hours, to give 4.5 g of a crystal of the unsubstituted titanyl phthalocyanine (CGM-1) represented by Formula (8) (TiOPcA) (blue powder).

Figure 7:
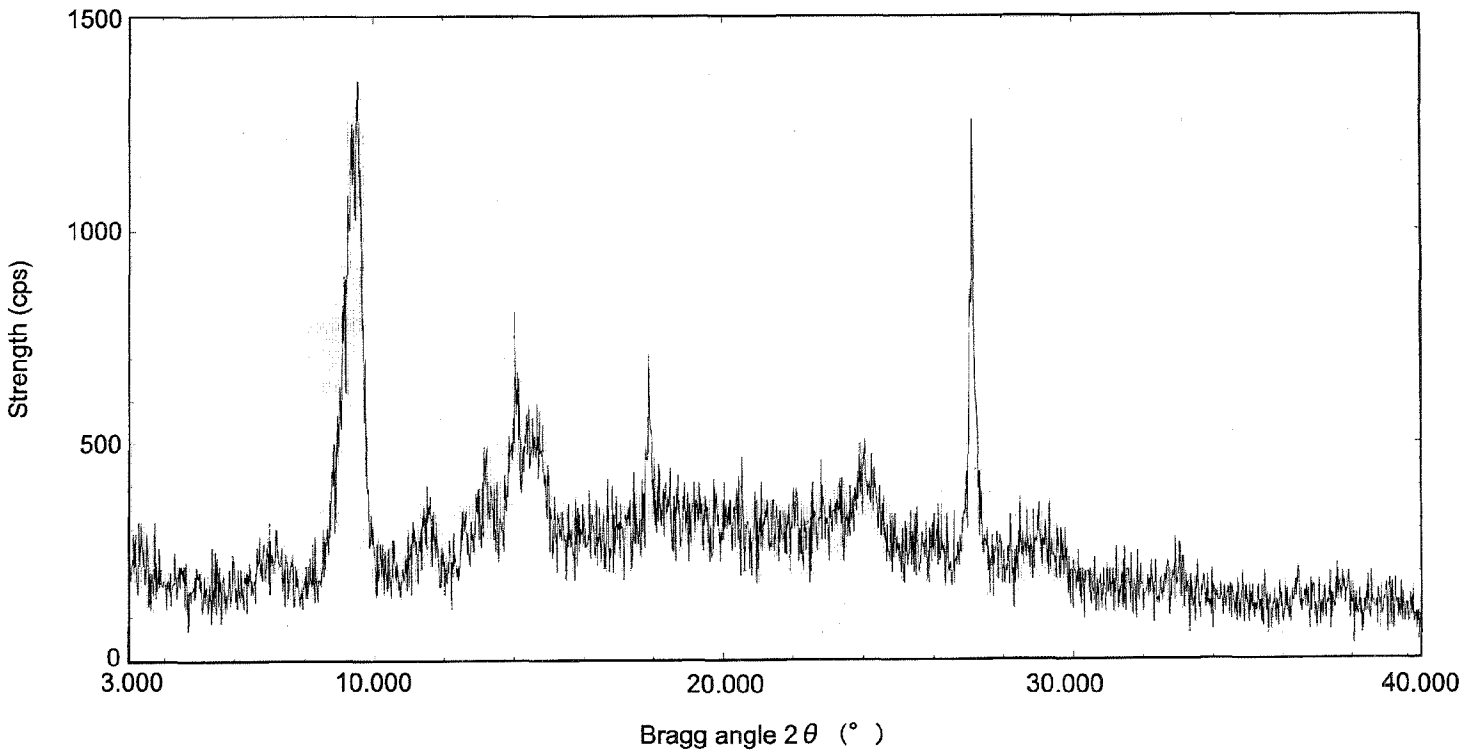
FIG. 7 is a CuKα X-ray diffraction spectrum of a titanyl phthalocyanine crystal used in Example.

3. Evaluation of Titanyl Phthalocyanine Crystal (1) CuKα X-Ray Diffraction Spectrum Measurement 0.3 g of the titanyl phthalocyanine crystal obtained (TiOPc A) was dispersed in 5 g of tetrahydrofuran, and the dispersion was left under the condition of a temperature of 23±1° C. and a relative humidity of 50 to 60% in a tightly sealed container for 24 hours. After removal of tetrahydrofuran, the crystal was filled in the sample holder of an X-ray diffraction apparatus (RINT1100, manufactured by Rigaku Corp.) for measurement. The spectrum chart obtained is shown in FIG. 7. The spectrum chart having a maximum peak at a Bragg angle 2θ of 27.2°±0.2° but no peak at 26.2° indicated that the titanyl phthalocyanine crystal obtained had a stabilized specific crystal form. This is because the peak at a Bragg angle 2θ of 27.2°±0.2° is a peak characteristic to the specific crystal form, and the peak at 26.2° is a peak characteristic to the β crystal.

The measurement condition was as follows:

X-ray tube: Cu

Tube voltage: 40 kV

Tube current: 30 mA

Start angle: 3.0°

Stop angle: 40.0°

Scanning speed: 10°/minute (2) Differential Scanning Calorimetry

Figure 8:
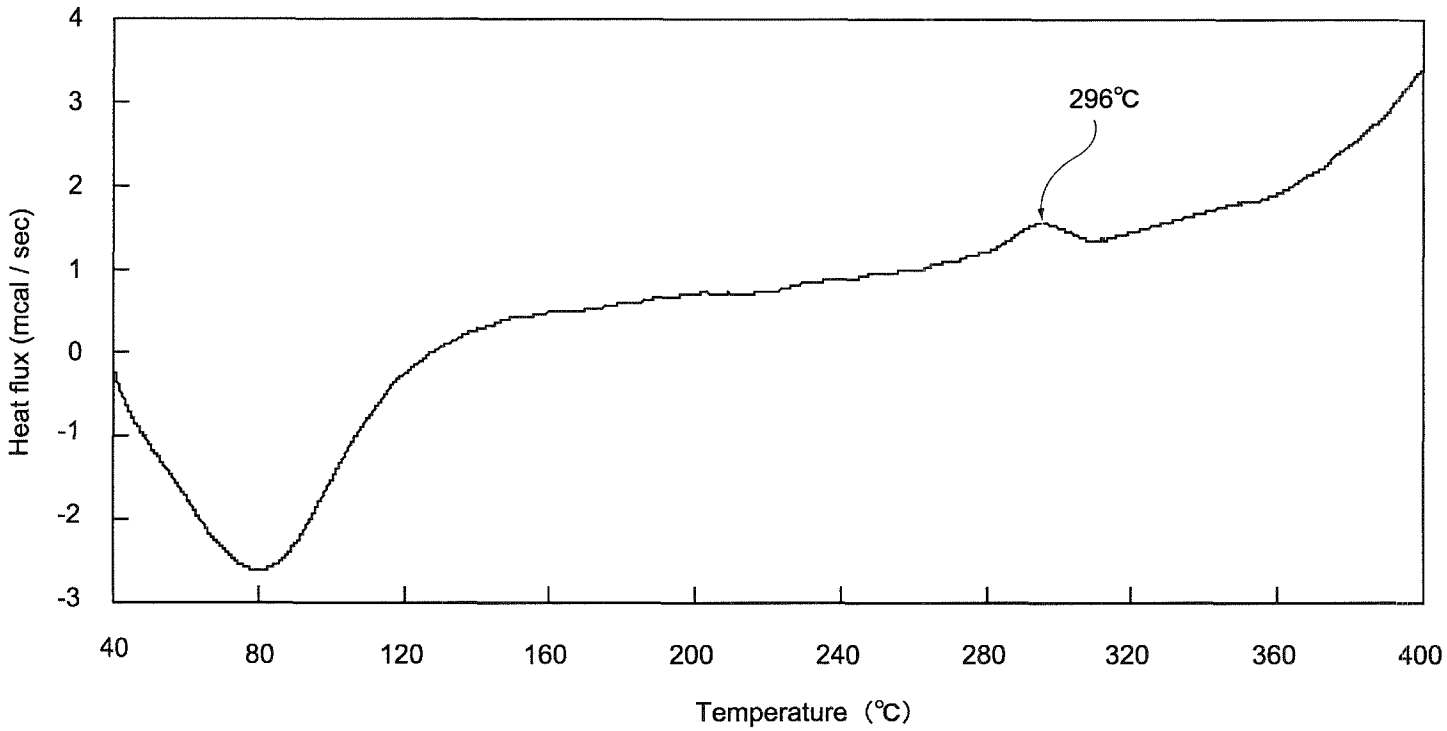
FIG. 8 is a differential scanning analysis chart of a titanyl phthalocyanine crystal used in Example.

Separately, differential scanning calorimetry of the titanyl phthalocyanine crystal obtained (TiOPc A) was performed by using a differential scanning calorimeter (TAS-200 type, DSC8230D, manufactured by Rigaku Corp.). The differential scanning analysis chart obtained is shown in FIG. 8. There were a peak due to vaporization of adsorbed water and also a peak at 296° C. observed in the chart.

The measuring condition was as follows:

Sample tray: aluminum

Heating speed: 20° C./minute (3) Measurement of Absorbance

Separately, 0.1 g (1.25 parts by weight) of the titanyl phthalocyanine crystal obtained (TiOPc A) was added to 8 g (100 parts by weight) of a mixed solvent of methanol and N,N-dimethylformamide (methanol:N,N-dimethylformamide=1:1 (by weight)), and the mixture was ultrasonicated at a constant liquid temperature of 23° C. in an ultrasonic cleaning machine for 1 hour, to give a suspension. The suspension obtained was then filtered through a 0.1-μm PTFE membrane film (manufactured by Advantest Corporation), to give a filtrate. The filtrate obtained was then placed in a cell having a cell length of 10 mm, and the absorbance by the filtrate of light at a wavelength of 400 nm was determined by using a photometer (Spectrophotometer U-3000, manufactured by HITACHI Co., Ltd.). The results obtained are summarized in Table 3.

4. Preparation of Electrophotographic Photoconductor

Placed in a container were 4 parts by weight of the titanyl phthalocyanine crystal (TiOPc A) for use as the charge generating agent, 50 parts by weight of the compound (HTM-4) represented by Formula (12) for use as the hole transfer agent, 30 parts by weight of the compound (ETM-1) represented by Formula (13) for use as the electron transfer agent, 100 parts by weight of a Z-type polycarbonate resin having a viscosity-average molecular weight of 20,000 (TS2020, manufactured by Teijin Chem. Ltd.) for use as the binding resin, and 800 parts by weight of a solvent tetrahydrofuran.

The mixture was then dispersed in a ball mill for 50 hours, to give an application liquid for single-layered photo sensitive layer. The application liquid obtained was then coated on a base body (simple aluminum tube) of 254 mm in length and 30 mm in diameter by dip coating under the condition of 130° C. for 30 minutes and dried with hot air, to give a monolayer type photoconductor carrying a single-layered photo sensitive layer having a film thickness of 30 μm.

5. Light-Absorbing Property

The absorption spectrum of the photo sensitive layer of the electrophotographic photoconductor obtained was determined.

Specifically, a uniform coating film (photo sensitive layer) having a thickness of 10 μm was formed on an OHP sheet by using the above-described application liquid for single-layered photo sensitive layer. The absorption spectrum of the coating film obtained was then determined by using a photometer (spectrophotometer U3000, manufactured by HITACHI Co., Ltd.).

The maximum absorption wavelength ($\lambda_{max}$) (nm) and the absorbance ($A_{850}$) ($\mu m^{-1}$) of light at a wavelength of 850 nm per unit thickness were determined from the absorption spectrum. The values obtained are summarized in Table 3.

6. Measurement of Sensitivity

The sensitivity of the electrophotographic photoconductor obtained was determined.

Specifically, a drum sensitivity test machine (manufactured by GENTEC) was charged to a surface potential of 850 V, and a monochromatic light at a wavelength of 780 nm (half value width: 20 nm, light intensity: 1.0 $\mu J/cm^2$) obtained though a band pulse filter from white light was then exposed on the electrophotographic photoconductor surface (exposure period: 50 msec). Then, the sensitivity, i.e., the electric potential 350 msec after exposure, was evaluated according to the following criteria. The results obtained are summarized in Table 3.

Very Good Sensitivity is below 120 V

Good: Sensitivity is 120 V or more and below 150 V

Bad: Sensitivity is 150 V or more

Example 2

In Example 2, an electrophotographic photoconductor was prepared and evaluated in the same manner as in Example 1, except that, in production of the electrophotographic photoconductor, the compound (HTM-1) represented by Formula (9) was used as the hole transfer agent. The results obtained are summarized in Table 3.

Example 3

In Example 3, an electrophotographic photoconductor was prepared and evaluated in the same manner as in Example 1, except that, in production of the electrophotographic photoconductor, the compound (HTM-2) represented by Formula (10) was used as the hole transfer agent. The results obtained are summarized in Table 3.

Example 4

In Example 4, an electrophotographic photoconductor was prepared and evaluated in the same manner as in Example 1, except that, in production of the electrophotographic photoconductor, the compound (HTM-3) represented by Formula (11) was used as the hole transfer agent. The results obtained are summarized in Table 3.

Example 5

In Example 5, an electrophotographic photoconductor was prepared and evaluated in the same manner as in Example 1, except that, in production of the electrophotographic photoconductor, the compound (ETM-2) represented by Formula (14) was used as the electron transfer agent. The results obtained are summarized in Table 3.

Example 6

In Example 6, an electrophotographic photoconductor was prepared and evaluated in the same manner as in Example 1, except that, in production of the electrophotographic photoconductor, the compound (ETM-3) represented by Formula (15) was used as the electron transfer agent. The results obtained are summarized in Table 3.

Examples 7 and 8

In Examples 7 and 8, an electrophotographic photoconductor was prepared and evaluated in the same manner as in Examples 5 and 6, except that, in production of the electrophotographic photoconductor, the compound (HTM-1) represented by Formula (9) was used as the hole transfer agent. The results obtained are summarized in Table 3.

Examples 9 and 10

In Example 9 and 10, an electrophotographic photoconductor was prepared and evaluated in the same manner as in Examples 5 and 6, except that, in production of the electrophotographic photoconductor, the compound (HTM-2) represented by Formula (10) was used as the hole transfer agent. The results obtained are summarized in Table 3.

Comparative Example 1

In Comparative Example 1, a titanyl phthalocyanine crystal (TiOPc-B) prepared in the same manner as in Example 1, except that, in the pigmentation treatment in preparation of the titanyl phthalocyanine crystal as the charge generating agent, the wet cake was suspended and washed four times in 270 ml of water at 60° C., instead of dispersion and washing four times with 500 ml of methanol. An electrophotographic photoconductor was prepared and evaluated in the same manner as in Example 1, except the processing above. The results obtained are summarized in Table 3.

Comparative Example 2

In Comparative Example 2, a titanyl phthalocyanine crystal (TiOPc-B) prepared in the same manner as in Example 1, except that, in the pigmentation treatment in preparation of the titanyl phthalocyanine crystal as the charge generating agent, the wet cake was suspended and washed four times in 270 ml of water at 40° C., instead of dispersion and washing four times with 500 ml of methanol. An electrophotographic photoconductor was prepared and evaluated in the same manner as in Example 1, except the processing above. The results obtained are summarized in Table 3.

TABLE 3

| | Charge generating agent | | Hole | | Light-absorbing property: Absorption maximum | | | | Sensitivity characteristics | |
|---|---|---|---|---|---|---|---|---|---|---|
| | Kind | Absorbance ($\lambda_{400}$) (−) | transfer agent | Electron transfer agent | $\lambda_{max}$ (nm) | $A_{\lambda max}$ ($\mu m^{-1}$) | $A_{850}$ ($\mu m^{-1}$) | $\lambda_{max}/A_{850}$ ($1 \times 10^{-12} m^2$) | Sensitivity (V) | Judgment |
| Example 1 | TiOPc-A | 0.012 | HTM-4 | ETM-1 | 795 | 0.061 | 0.0442 | 17.99 | 119 | Very Good |
| Example 2 | | | HTM-1 | | 796 | 0.060 | 0.0440 | 18.09 | 118 | Very Good |
| Example 3 | | | HTM-2 | | 801 | 0.057 | 0.0446 | 17.96 | 123 | Good |
| Example 4 | | | HTM-3 | | 800 | 0.058 | 0.0440 | 18.18 | 125 | Good |
| Example 5 | | | HTM-4 | ETM-2 | 799 | 0.059 | 0.0443 | 18.04 | 132 | Good |
| Example 6 | | | | ETM-3 | 799 | 0.058 | 0.0439 | 18.20 | 120 | Good |
| Example 7 | | | HTM-1 | ETM-2 | 800 | 0.059 | 0.0438 | 18.26 | 135 | Good |
| Example 8 | | | | ETM-3 | 798 | 0.057 | 0.0440 | 18.14 | 122 | Good |
| Example 9 | | | HTM-2 | ETM-2 | 808 | 0.051 | 0.0441 | 18.32 | 131 | Good |
| Example 10 | | | | ETM-3 | 803 | 0.053 | 0.0430 | 18.67 | 130 | Good |
| Comparative Example 1 | TiOPc-B | 0.103 | HTM-4 | ETM-1 | 814 | 0.057 | 0.0528 | 15.42 | 172 | Bad |
| Comparative Example 2 | TiOPc-C | 0.148 | | | 859 | 0.043 | 0.0429 | 20.02 | 162 | Bad |

As described above in detail, according to the present invention, it is possible to make the dispersibility of the charge generating agent in the photo sensitive layer favorable and thus to improve the sensitivity characteristics, by adjusting the maximum absorption wavelength of the photo sensitive layer in the monolayer type photoconductor and also the absorbance of the light at a predetermined wavelength per unit thickness of the photo sensitive layer in favorable ranges.

It is thus possible to obtain a monolayer type photoconductor superior in sensitivity characteristics that allows reliable production by easy confirmation of the sensitivity characteristics, and an image forming device using such a monolayer type photoconductor.

Accordingly, the monolayer type photoconductor and the image forming device using the same according to the present invention are expected to contribute to acceleration, improvement in quality and productivity, and others of various image forming devices such as copying machines and printers.

What is claimed is:

1. A monolayer type photoconductor, comprising a base body and a single photo sensitive layer formed on the base body, the single photo sensitive layer containing a charge generating agent, a hole transfer agent, an electron transfer agent and a binding resin, wherein the maximum absorption wavelength ($\lambda_{max}$) of the photo sensitive layer is below 850 nm and an absorbance ($A_{850}$) of light at a wavelength of 850 nm per unit thickness of the photo sensitive layer is 0.05 $\mu m^{-1}$ or less, wherein the maximum absorption wavelength ($\lambda_{max}$) of the photo sensitive layer and the absorbance ($A_{850}$) of light at a wavelength of 850 nm per unit thickness of the photo sensitive layer satisfy the following relationship formula (1'):

$$17 \leq \lambda_{max}/A_{850}(1\times10^{-12}\ m^2) \leq 19.5 \quad (1')$$

wherein the charge generating agent is a titanyl phthalocyanine crystal having maximum peaks at Bragg angles 2θ of 9.5°±0.2° and 27.2°±0.2°, in a CuKα X-ray diffraction spectrum, wherein the titanyl phthalocyanine crystal has two peaks in a range of 50 to 400° C. by differential scanning calorimetry, with one peak due to vaporization of adsorbed water in the range of 50 to 270° C., and one peak in the range of 270 to 400° C., and wherein the titanyl phthalocyanine crystal having an absorbance of light at a wavelength of 400 nm, as determined as a solution obtained by suspending 1.25 parts by weight of the titanyl phthalocyanine crystal in 100 parts by weight of a mixed solvent of methanol and N,N-dimethylformamide (methanol:N,N-dimethylformamide=1:1 (by weight)) and filtering the suspension, in the range of 0.01 to 0.08 is used as the titanyl phthalocyanine crystal, and the titanylphthalocyanine crystal is prepared in a production method including the steps of:

a) dissolving a crude titanyl phthalocyanine crystal in an acid to obtain a titanyl phthalocyanine solution;

(b) adding the titanyl phthalocyanine solution dropwise into a poor solvent to obtain a wet cake;

(c) washing the wet cake with an alcohol having 1 to 4 carbon atoms in a pigmentation treatment; and (d) heating and agitating the washed wet cake in a nonaqueous solvent to obtain the titanyl phthalocyanine crystal.

2. The monolayer type photoconductor according to claim 1, wherein the alcohol having 1 to 4 carbon atoms is methanol.

3. The monolayer type photoconductor according to claim 1, wherein an absorbance ($A_{780}$) of light at a wavelength of 780 nm per unit thickness of the photo sensitive layer is set to a value of 0.045 ($\mu m^{-1}$) or more.

4. The monolayer type photoconductor according to claim 1, wherein a content of the charge generating agent is in the range of 0.1 to 50 parts by weight with respect to 100 parts by weight of the binding resin.

5. The monolayer type photoconductor according to claim 1, wherein a thickness of the photo sensitive layer is in the range of 5 to 100 μm.

6. An image forming device, comprising the monolayer type photoconductor according to claim 1, and electrification means, exposure means, developing means and transfer means arranged around the monolayer type photoconductor, wherein a process speed is set to a value of 100 mm/sec or more.

7. The monolayer type photoconductor according to claim 1, wherein the hole transfer agent is a triarylamine compound represented by the following General Formula (1):

(1)

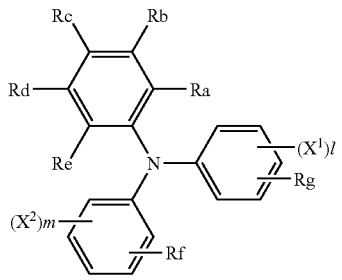

wherein Ra to Rg each independently represents a hydrogen or halogen atom, an alkyl group having 1 to 20 carbon atoms, an alkoxy group having 1 to 20 carbon atoms, a substituted or unsubstituted aryl group having 6 to 30 carbon atoms, or neighboring two substituents among Ra to Re may form a hydrocarbon ring structure; $X^1$ and $X^2$ each independently represents a substituent represented by the following General Formula (2); and each of the repetition numbers l and m is an integer satisfying (l+m≥2):

(2)

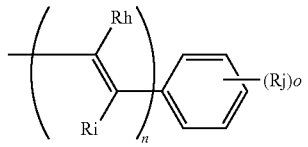

wherein Rh to Ri each independently represents a hydrogen atom, an alkyl group having 1 to 20 carbon atoms, or a substituted or unsubstituted aryl group having 6 to 30 carbon atoms; the repetition number n is an integer of 1 to 2; Rj represents a halogen atom, an alkyl group having 1 to 20 carbon atoms, an alkoxy group having 1 to 20 carbon atoms, or a substituted or unsubstituted aryl group having 6 to 30 carbon atoms; and the repetition number o is an integer of 0 to 5.

8. The monolayer type photoconductor according to claim 1, wherein the electron transfer agent is at least one compound selected from the group consisting of the compounds represented by the following General Formulae (3) to (5):

(3)

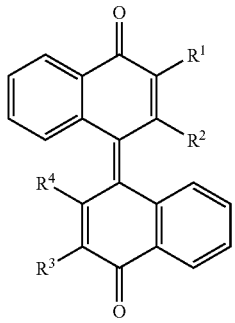

wherein $R^1$ to $R^4$ each independently represents a hydrogen or halogen atom, a substituted or unsubstituted alkyl group having 1 to 20 carbon atoms, a substituted or unsubstituted alkoxy group having 1 to 20 carbon atoms, or a substituted or unsubstituted aryl group having 6 to 30 carbon atoms, (4)

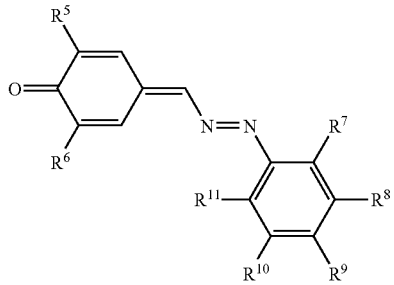

wherein $R^5$ to $R^6$ each independently represents a hydrogen atom, a substituted or unsubstituted alkyl group having 1 to 20 carbon atoms, a substituted or unsubstituted alkoxy group having 1 to 20 carbon atoms, a substituted or unsubstituted aryl group having 6 to 30 carbon atoms, a substituted or unsubstituted cycloalkyl group having 6 to 30 carbon atoms, or a substituted or unsubstituted aralkyl group having 7 to 20 carbon atoms; $R^7$ to $R^{11}$ each independently represents a hydrogen or halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 7 to 20 carbon atoms, a substituted or unsubstituted phenoxy group having 6 to 30 carbon atoms, a cyano group, a nitro group, or a heterocyclic group formed by two or more groups binding to each other, and (5)

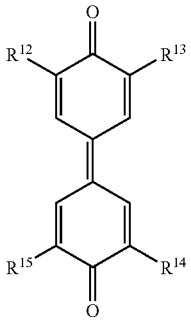

wherein the substituted groups $R^{12}$ to $R^{15}$ each independently represents a hydrogen atom, a substituted or unsubstituted alkyl group having 1 to 20 carbon atoms, a substituted or unsubstituted aryl group having 6 to 30 carbon atoms, a substituted or unsubstituted alkoxy group having 1 to 20 carbon atoms, or a substituted or unsubstituted cycloalkyl group having 6 to 30 carbon atoms.

* * * * *